US011662671B2

(12) United States Patent
Tsukada et al.

(10) Patent No.: US 11,662,671 B2
(45) Date of Patent: May 30, 2023

(54) IMAGE FORMING APPARATUS HAVING DEVELOPMENT APPARATUS INCLUDING SHEET MEMBER WHICH IS DISPOSED BELOW POSITION ON DEVELOPER BEARING MEMBER WHERE DEVELOPER BEARING MEMBER IS CLOSEST TO IMAGE BEARING MEMBER

(71) Applicant: CANON KABUSHIKI KAISHA, Tokyo (JP)

(72) Inventors: Yoshiro Tsukada, Chiba (JP); Koji Shigehiro, Chiba (JP); Shunsuke Tsuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/484,967

(22) Filed: Sep. 24, 2021

(65) Prior Publication Data

US 2022/0100122 A1 Mar. 31, 2022

(30) Foreign Application Priority Data

Sep. 28, 2020 (JP) ..... JP2020-162159

(51) Int. Cl.
*G03G 15/08* (2006.01)
*G03G 15/00* (2006.01)

(52) U.S. Cl.
CPC ..... *G03G 15/0812* (2013.01); *G03G 15/50* (2013.01)

(58) Field of Classification Search
CPC ..... G03G 15/0812; G03G 15/50
See application file for complete search history.

(56) References Cited

U.S. PATENT DOCUMENTS

2019/0171130 A1* 6/2019 Koga ..... G03G 15/0898

FOREIGN PATENT DOCUMENTS

JP 2015069190 A 4/2015

* cited by examiner

*Primary Examiner* — Walter L Lindsay, Jr.
*Assistant Examiner* — Milton Gonzalez
(74) *Attorney, Agent, or Firm* — Canon U.S.A., Inc. I.P. Division

(57) ABSTRACT

An image forming apparatus includes a controller, a drive unit, a developer bearing member, a regulation blade, and a sheet member. During non-image forming, the controller executes a control mode for controlling the drive unit to rotatably drive the developer bearing member in a second direction opposite to a first direction, and then rotatably drive the developer bearing member in the first direction. A portion above a horizontal line passing through a tip of the regulation blade out of the sheet member is disposed in a moving path of a developer born by the developer bearing member when the drive unit rotatably drives the developer bearing member in the second direction in the control mode, and is not disposed in the moving path of the developer born by the developer bearing member when the drive unit rotatably drives the developer bearing member in the first direction during image forming.

16 Claims, 20 Drawing Sheets

FIG.11

| | | MAGENTA | | | | CYAN | | | |
|---|---|---|---|---|---|---|---|---|---|
| FORWARD ROTATIONAL SPEED | NUMBER OF REPETITIONS | LEVEL 1 | LEVEL 2 | LEVEL 3 | TOTAL | LEVEL 1 | LEVEL 2 | LEVEL 3 | TOTAL |
| CONVENTIONAL EXAMPLE | | 6.80 | 2.00 | 0.80 | 9.60 | 2.40 | 1.60 | 0.60 | 4.60 |
| FIRST EXEMPLARY EMBODIMENT | 3 TIMES | 2.00 | 0.00 | 1.25 | 3.25 | 0.25 | 0.25 | 0.75 | 1.25 |

FIG.13

| | SHEET STATE WITH RESPECT TO DEVELOPER IN DEVELOPMENT DOMAIN AND PHOTOSENSITIVE DRUM SURFACE | | |
|---|---|---|---|
| | (CASE 1) NON-CONTACT | (CASE 2) ONLY TIP CONTACT | (CASE 3) ENTERING |
| STAIN (FORWARD ROTATION) | × | × | ○ |
| STAIN (REVERSE ROTATION) | × | ○ | ○ |
| FUSING | ○ | ○ | × |

FIG.19

| | | MAGENTA | | | | CYAN | | | |
|---|---|---|---|---|---|---|---|---|---|
| FORWARD ROTATIONAL SPEED | NUMBER OF REPETITIONS | LEVEL 1 | LEVEL 2 | LEVEL 3 | TOTAL | LEVEL 1 | LEVEL 2 | LEVEL 3 | TOTAL |
| CONVENTIONAL EXAMPLE | | 6.80 | 2.00 | 0.80 | 9.60 | 2.40 | 1.60 | 0.60 | 4.60 |
| FIRST EXEMPLARY EMBODIMENT | 3 TIMES | 2.00 | 0.00 | 1.25 | 3.25 | 0.25 | 0.25 | 0.75 | 1.25 |
| SECOND EXEMPLARY EMBODIMENT A | 3 TIMES | 0.80 | 0.60 | 0.20 | 1.60 | 0.20 | 0.30 | 0.50 | 1.00 |
| SECOND EXEMPLARY EMBODIMENT B | 5 TIMES | 0.50 | 0.25 | 0.25 | 1.00 | 0.50 | 0.00 | 0.00 | 0.50 |

IMAGE FORMING APPARATUS HAVING DEVELOPMENT APPARATUS INCLUDING SHEET MEMBER WHICH IS DISPOSED BELOW POSITION ON DEVELOPER BEARING MEMBER WHERE DEVELOPER BEARING MEMBER IS CLOSEST TO IMAGE BEARING MEMBER

BACKGROUND

Field

The present disclosure relates to an image forming apparatus having a development apparatus that develops an electrostatic latent image formed on an image bearing member.

Description of the Related Art

The development apparatus includes a development sleeve as a rotatable developer bearing member that carries and conveys a two-component developer (hereinafter simply referred to as a developer) containing a toner and a carrier to a development region for developing an electrostatic latent image formed on an image bearing member. The development sleeve includes a magnet having a plurality of magnetic poles and generating a magnetic field for allowing the development sleeve to bear the developer on the surface of the development sleeve. The magnet is fixedly disposed in a non-rotatable way.

A regulation blade as a developer regulation member that regulates the amount of the developer born by the development sleeve is disposed to face the development sleeve via a predetermined gap (hereinafter referred to as an SB gap) between the regulation blade and the development sleeve. The SB gap refers to the shortest distance between the development sleeve and the regulation blade. Adjusting the amount of the SB gap enables adjusting the amount of the developer to be conveyed to the development region.

The developer is born and conveyed to the development region by the development sleeve. When the developer is magnetically stood in the development region by the magnetic poles of the magnet, a magnetic brush is formed. When the toner in the developer supplied from the magnetic brush is supplied to the electrostatic latent image in the development region, the electrostatic latent image is developed into a toner image.

After passing through the SB gap, the magnetic brush of the developer formed on the development sleeve starts falling down on the downstream side of the SB gap in the rotational direction of the development sleeve. At this timing, if the toner electrostatically adhering to the surface of the carrier in the developer on the development sleeve is separated from the carrier by the centrifugal force, and then the separated toner is scattered, there will be a relative increase in the amount of toner floating in the space ranging from the development region downward in the direction of gravity.

The development apparatus discussed in Japanese Patent Application Laid-Open No. 2015-69190 includes a sheet member (hereinafter referred to as a toner capture sheet) for capturing toner scattered from the development region downward in the direction of gravity. The toner capture sheet is disposed in the vicinity of the development sleeve, in contact with the image bearing member.

The toner scattered from the development region downward in the direction of gravity accumulates on the toner capture sheet over time. The toner accumulating on the toner capture sheet changes to a toner layer in a loosely aggregated state. Meanwhile, the toner layer of the toner accumulating on the toner capture sheet may collapse by the influence of an irregular vibration due to the operation of the image forming apparatus. If the toner layer of the toner accumulating on the toner capture sheet is collapsed, a toner aggregate drops onto the development sleeve or onto the magnetic brush on the development sleeve. Then, if the toner aggregate is conveyed to the development region together with the magnetic brush and adheres to the electrostatic latent image, a defective image may possibly occur.

To prevent the toner accumulating on the toner capture sheet from being used for the development during image forming, it is desirable to collect the toner accumulating on the toner capture sheet during non-image forming.

In the configuration discussed in Japanese Patent Application Laid-Open No. 2015-69190, an electromagnet is provided on the side of the development region of a regulation blade below the development region in the direction of gravity, and power is supplied to the electromagnet during non-image forming. In this state, the development sleeve is subjected to a reverse rotation operation and then a forward rotation operation. More specifically, in the configuration discussed in Japanese Patent Application Laid-Open No. 2015-69190, the developer (magnetic brush) is magnetically stood by the magnetic field generated by the electromagnet supplied with power, and the developer is brought into contact with the toner accumulating on the toner capture sheet to collect the toner accumulating on the toner capture sheet.

However, in the configuration discussed in Japanese Patent Application Laid-Open No. 2015-69190, a space for disposing the electromagnet in addition to the toner capture sheet needs to be provided in the space ranging from the development region downward in the direction of gravity, possibly resulting in an increase in the apparatus size.

SUMMARY

The present disclosure is directed to collecting the toner accumulating on a toner capture sheet during non-image forming, with a simple configuration.

According to an aspect of the present disclosure, an image forming apparatus includes an image bearing member on which an electrostatic latent image is formed, an exposure apparatus configured to expose the image bearing member to light to form the electrostatic latent image on the image bearing member, a development apparatus including a development container, a developer bearing member, a magnet, and a regulation blade, wherein the development container is configured to accommodate a developer including a toner and a carrier, wherein the developer bearing member is rotatable and configured to bear and convey the developer to develop the electrostatic latent image formed on the image bearing member, wherein the magnet is non-rotatably and fixedly disposed in the developer bearing member and configured to generate a magnetic field to allow the developer bearing member to bear the developer, and wherein the regulation blade is disposed below a position on the developer bearing member where the developer bearing member is closest to the image bearing member, so as to face the developer bearing member in non-contact with the developer bearing member, and is configured to regulate an amount of the developer born by the developer bearing member, a sheet member disposed below the position on the developer bearing member where the developer bearing member is closest to the image bearing member and in contact with the image bearing member, wherein the sheet member is configured to cover at least a part of a space partitioned by the regulation blade, the developer bearing member, and the image bearing member, a drive unit configured to rotatably drive the developer bearing member, and a controller configured to control the drive unit to rotatably drive the developer bearing member in a first direction during image forming, wherein, during non-image forming, the controller executes a control mode for controlling the drive unit to rotatably drive the developer bearing member in a second direction opposite to the first direction, and then rotatably drive the developer bearing member in the first direction, and wherein a portion above a horizontal line passing through a tip of the regulation blade out of the sheet member is disposed in a moving path of the developer born by the developer bearing member in a case where the drive unit rotatably drives the developer bearing member in the second direction in the control mode, and is not disposed in the moving path of the developer born by the developer bearing member in a case where the drive unit rotatably drives the developer bearing member in the first direction during image forming.

Further features of the present disclosure will become apparent from the following description of exemplary embodiments with reference to the attached drawings.

BRIEF DESCRIPTION OF THE DRAWINGS

FIG. 11 illustrates effects of the toner collection mode according to the first exemplary embodiment.

FIG. 13 illustrates effects of the toner collection mode according to the first exemplary embodiment.

FIG. 19 illustrates effects of the toner collection mode according to the third exemplary embodiment.

DESCRIPTION OF THE EMBODIMENTS

Figure 1:
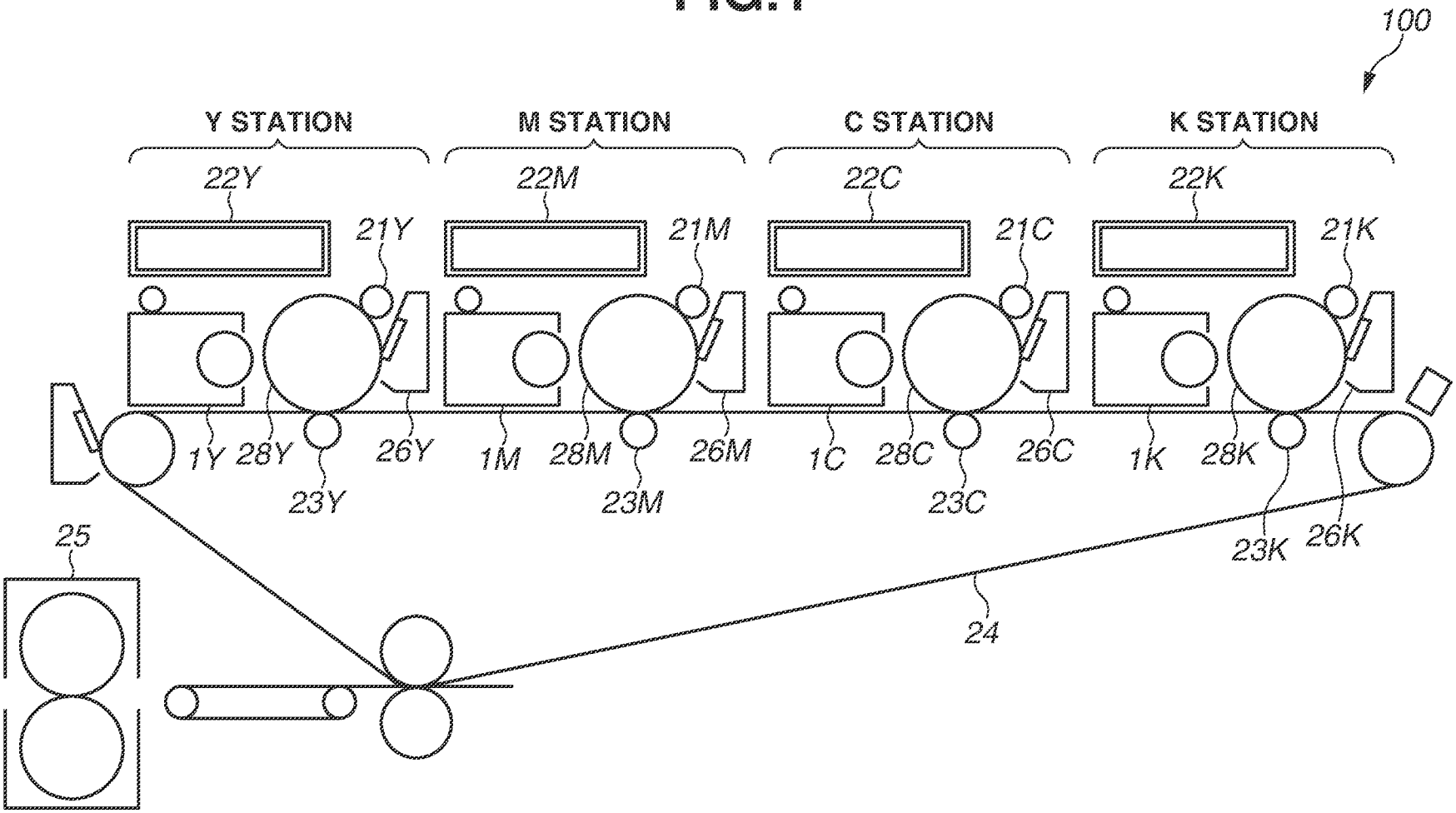
FIG. 1 is a cross-sectional view illustrating a configuration of an image forming apparatus according to a first exemplary embodiment.

Exemplary embodiments of the present disclosure will be described in detail below with reference to the accompanying drawings. The following exemplary embodiments do not limit the present disclosure within the ambit of the appended claims. Not all of the combinations of the features described in the present exemplary embodiment are indispensable to the solutions for the present disclosure. The present disclosure can be implemented in printers, various types of printing apparatuses, copying machines, facsimiles, multifunction peripherals, and other various applications.

(Configuration of Image Forming Apparatus)

The overview of the image forming apparatus according to the first exemplary embodiment will be described below with reference to the cross-sectional view in FIG. 1. An image forming apparatus 100 is an electrophotographic color image forming apparatus. In recent years, an intermediate transfer tandem system has been the main stream because of its excellent advantages in the adaptability to diverse types of transfer paper and the printing productivity. This system uses image forming units for four different colors juxtaposed above an intermediate transfer member 24. The intermediate transfer tandem system is also employed in the first exemplary embodiment. The drum cartridges for performing the toner image forming process for four colors (yellow, magenta, cyan, and black) are juxtaposed. Four different color images are overlapped on the intermediate transfer member 24 and then collectively transferred on transfer paper. Then, the image on the paper is pressurized and heated by a fixing unit 25 to obtain a full color image.

In the following descriptions, reference numerals omitting symbols Y, M, C, and K indicate common portions of the drum cartridges for yellow, magenta, cyan, and black, respectively, illustrated in FIG. 1.

When the surface of a photosensitive drum 28 (image bearing member) charged by a primary charging apparatus 21 is exposed to laser 22, an electrostatic latent image is formed on the photosensitive drum 28. Then, the electrostatic latent image formed on the photosensitive drum 28 is developed by a development apparatus 1 to obtain a toner image. The toner image on each photosensitive drum 28 is transferred to an intermediate transfer belt 24 by a primary transfer roller 23 in a multiple way. Residual toner on the photosensitive drum 28 after the image transfer is removed by a cleaner 26.

(Configuration of Development Apparatus)

The configuration of the development apparatus 1 according to the first exemplary embodiment will be described below with reference to the cross-sectional view and schematic view in FIG. 2. The development apparatus 1 includes a development container 2 that accommodates the developer (two-component developer) containing a toner and a carrier, and a development sleeve 3 disposed at the opening of the development container 2. The first exemplary embodiment uses the two-component development method in which a nonmagnetic toner having the negative charge polarity and a magnetic carrier are mixed to be used as the developer. The nonmagnetic toner is produced by including a coloring agent and a wax component in a resin such as polyester and styrene acrylic, and then subjecting the resin to granulation or polymerization for powdering. The magnetic carrier is composed of a core made of ferrite particles and resin particles with kneaded magnetic powder, and a resin coating applied to the surface of the core. The toner density in the developer (the weight ratio of the toner contained in the developer) in the initial state is set to 8% in the first exemplary embodiment.

The magnetic carrier has an average particle diameter (50% particle diameter: D50) of 25 to 50 μm based on the volume distribution. The first exemplary embodiment uses the magnetic carrier having a volume average particle diameter of 35 μm. As such carrier particles, ferrite particles (Cu—Zn ferrite having a maximum magnetization of 230 emu/cm$^3$) or ferrite particles with resin coating can be preferably used.

The average particle diameter (50% particle diameter: D50) of the magnetic carrier based on the volume distribution is measured by using a multi-image analyzer from BECKMAN COULTER.

The particle distribution measurement was performed by using a particle distribution measurement apparatus of a laser diffraction and scattering type ("Micro Track MT3300EX" from NIKKISO Corporation). In the measurement, a sample feeder for identification measurement (One-shot Dry Type Sample Conditioner Turbotrac from NIKKISO Corporation) was attached. Supply conditions for Turbotrac include an air volume of about 33 liters/second and a pressure of 17 kPa with the use of a dust collector as a vacuum source. Control is automatically performed on a software basis. The 50% particle diameter (D50) is obtained as an accumulated value based on the volume distribution. Control and analysis are performed by using the attached software (version 10.3.3-202D). Measurement conditions are described below.

SetZero time: 10 seconds
Measuring time: 10 seconds
Number of measurements: Once
Particle refraction index: 1.81
Particle shape: Nonspherical
Upper limit of measurement: 1,208 μm
Lower limit of measurement: 0.243 μm
Measurement environment: Normal temperature normal humidity (23° C., 50% RH) environment The absolute specific gravity of the magnetic carrier is measured by using a dry type automatic densimeter (Accupyc 1330 from Shimadzu Corporation). Firstly, a sample of 5 g is left in a 23° C. 50% RH environment for 24 hours and put in a measurement cell (10 cm$^3$), and then the measurement cell is inserted into the sample chamber of the main body. Automatic measurement can be performed by inputting the sample mass to the main body and then starting measurement.

As a measurement condition for automatic measurement, a helium gas adjusted with 20.000 psig (2.392×102 kPa) is used. After purging the sample chamber 10 times, the sample chamber is repetitively purged with the helium gas until an equilibrium state is obtained, where the pressure change in the sample chamber becomes 0.005 psig ($3.447\times10^{-2}$ kPa/min). Then, the pressure in the sample chamber of the main body in the equilibrium state is measured. The sample volume can be calculated by the pressure change when the equilibrium state is reached (Boyle's law). Calculating the sample volume enables calculating the absolute specific gravity of the sample based on the following formula.

$$\text{Absolute specific gravity (g/cm}^3\text{)} = \text{Sample mass (g)} / \text{Sample volume (cm}^3\text{)}$$

The carrier may be a resin magnetic carrier composed of a binder resin and a magnetic metal oxide or nonmagnetic metal oxide. The resin magnetic carrier has a maximum magnetization of about 190 emu/cm$^3$ which is smaller than that of ferrite particles. Therefore, adjacent magnetic brush teeth magnetically interact with each other to a small extent. Accordingly, making magnetic brush teeth close and short enables providing an image with a high resolution without texture unevenness.

The method for calculating the magnetization level will be described below. We obtained the magnetization intensity of the carrier packed in a cylindrical form in an external magnetic field of 1 KOe (kilo Oersted) by using a vibration magnetic field type automatic magnetic characteristics recording apparatus from Riken Denshi Co., Ltd. Then, we calculated the magnetization level (emu/cm$^3$) by multiplying the magnification intensity by the absolute specific gravity of the carrier.

The development container 2 has an opening that faces the photosensitive drum 28. The development sleeve 3 as a developer bearing member is rotatably disposed at the opening of the development container 2 so that the development sleeve 3 is partly protruded. The development sleeve 3 is made of a nonmagnetic material and includes a fixed magnet roll 4 as a magnetic field generation unit. The magnet roll 4 having a plurality of magnetic poles is unrotatably and fixedly disposed in the development sleeve 3.

A regulation blade 5 as a developer regulation member that regulates the amount of the developer to be born by the development sleeve 3 is disposed to face the development sleeve 3 with a predetermined gap (hereinafter referred to as an SB gap) between the regulation blade 5 and the development sleeve 3. The SB gap refers to the shortest distance between the development sleeve 3 and the regulation blade 5.

Figure 2:
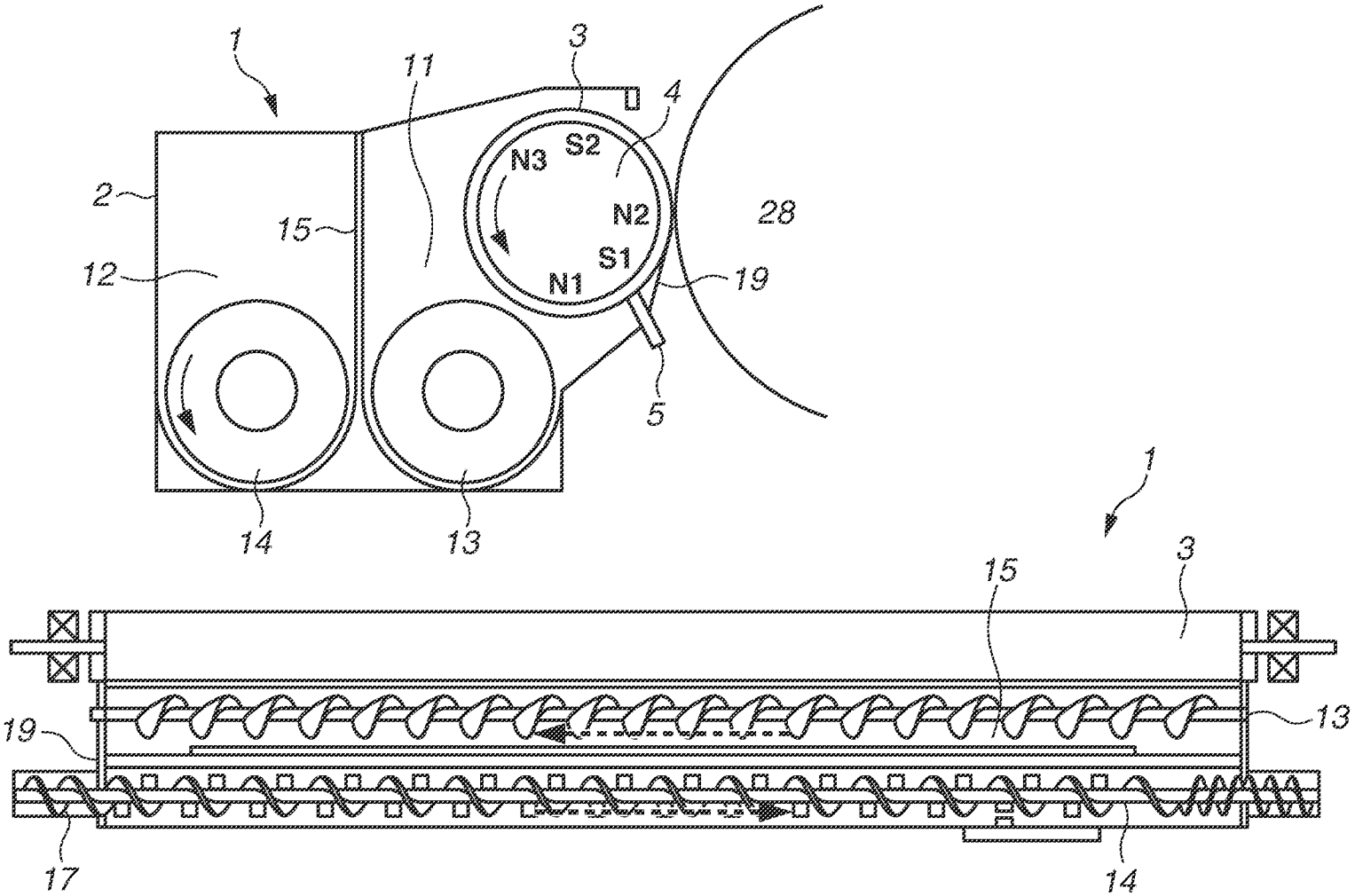
FIG. 2 is a cross-sectional view and a schematic view illustrating a configuration of a development apparatus according to the first exemplary embodiment.

Referring to FIG. 2, the development sleeve 3 rotates in the direction of the arrow (counterclockwise direction) to convey the developer adsorbed at the position of an N1 pole (pumping pole) of the magnet roll 4 toward the regulation blade 5. When the developer is magnetically stood (napped) by an S1 pole (regulation pole) of the magnet roll 4, the developer is subjected to the shearing force by the regulation blade 5, and the amount of the developer is regulated. When the developer passes through the SB gap, a developer layer having a predetermined thickness is formed on the development sleeve 3. When the developer layer on the development sleeve 3 is born and conveyed to the development region disposed to face the photosensitive drum 28, the developer develops the electrostatic latent image formed on the surface of the photosensitive drum 28 in a state where a magnetic brush is formed by an N2 pole (development pole) of the magnet roll 4. The developer after being used for the development is peeled from the development sleeve 3 by the nonmagnetic force band between an N3 pole (stripping pole) and the N1 pole (pumping pole) of the magnet roll 4.

The development container 2 is partitioned into a development chamber 11 and a stirring chamber 12 by a partition wall 15. The development chamber 11 and the stirring chamber 12 extend along the rotational axis direction of the development sleeve 3. Both ends of the partition wall 15 do not reach the side walls at both longitudinal ends in the development container 2. Thus, communication portions that allow the developer to communicate between the development chamber 11 and the stirring chamber 12 are formed. The formed communication portions include a first communication portion that allows the developer to communicate from the development chamber 11 to the stirring chamber 12, and a second communication portion that allows the developer to communicate from the stirring chamber 12 to the development chamber 11.

The development chamber 11 and the stirring chamber 12 are provided with a first screw 13 and a second screw 14, respectively, as circulation conveyance members for circulating the developer between the development chamber 11 and the stirring chamber 12. The development sleeve 3, the first screw 13, and the second screw 14 are connected by a gear train and configured to transmit drive. Each of the development sleeve 3, the first screw 13, and the second screw 14 rotates by the drive received from the drive gear of the development apparatus 1. When the first screw 13 and the second screw 14 rotate, the developer is mixed and stirred while being circulated in the development container 2.

Replenished toner is supplied from a replenishing port 17 disposed on the uppermost stream side in the conveyance direction of the second screw 14. The toner replenished from the replenishing port 17 is conveyed into the stirring chamber 12 by the second screw 14. Then, after the toner is stirred and mixed with the developer, the toner is uniformly diffused into the developer while being subjected to frictional charging.

After the magnetic brush of the developer formed on the development sleeve 3 passes through the SB gap, the magnetic brush starts falling down on the downstream side of the SB gap in the rotational direction of the development sleeve 3. When the toner having a low charge amount passes through the regulation blade 5 in the above-described process, the toner electrostatically adhering to the surface of the carrier in the developer on the development sleeve 3 is isolated from the carrier by the centrifugal force. The force by the movement of the magnetic brush of the carrier on the development sleeve 3 separates from the carrier the toner electrostatically adhering to the surface of the carrier in the developer on the development sleeve 3. If the separated toner is scattered out of the development container 2, there will be a relative increase in the amount of toner floating in the space ranging from the development region downward in the direction of gravity.

Accordingly, to prevent the separated toner from being scattered out of the development container 2, a toner capture sheet 19 for capturing the separated toner is disposed on the regulation blade 5. The toner capture sheet 19 is disposed in the vicinity of the development sleeve 3 and in contact with the photosensitive drum 28. According to the first exemplary embodiment, a urethane sheet having a thickness of 100 μm is used as the toner capture sheet 19.

The toner capture sheet 19 is stuck on the regulation blade 5 with a double-stick tape via a sticking stand so that the toner capture sheet 19 forms a predetermined angle relative to the regulation blade 5. According to the first exemplary embodiment, the sticking stand for the toner capture sheet 19 is made of a resin and is attached to the regulation blade 5. When the regulation blade 5 is made of a resin, the sticking stand for the toner capture sheet 19 and the regulation blade 5 may be integrally formed of the resin.

Figure 3:
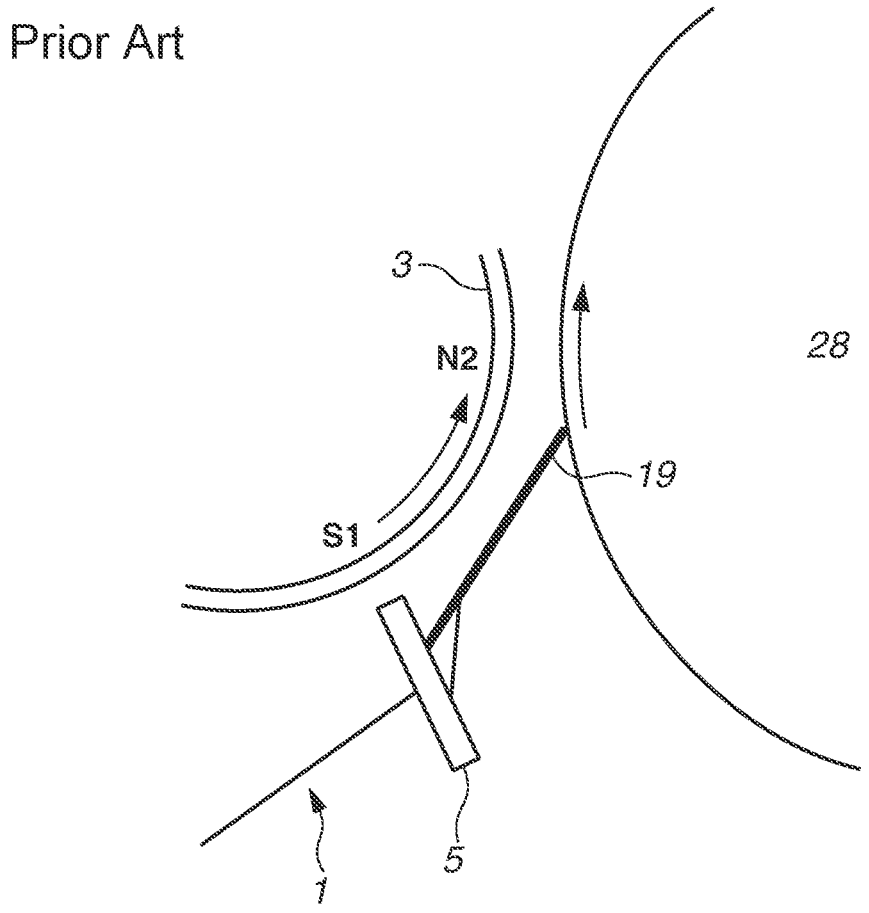
FIG. 3 is a cross-sectional view illustrating a configuration in the vicinity of a toner capture sheet in a conventional development apparatus.

The configuration in the vicinity of the toner capture sheet 19 in the conventional development apparatus will be described below with reference to the cross-sectional view in FIG. 3. The toner capture sheet 19 is stuck on the regulation blade 5 to seal the space surrounded by three different members (the regulation blade 5, the development sleeve 3, and the photosensitive drum 28) and come into contact with the photosensitive drum 28.

Figure 4:
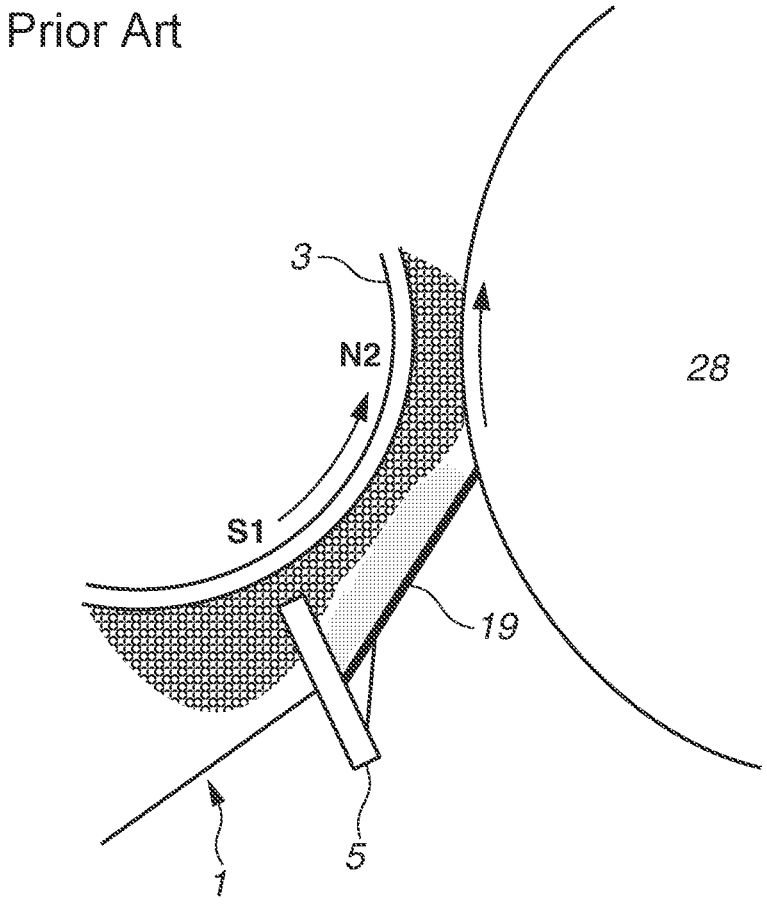
FIG. 4 illustrates a state where toner is accumulated on the toner capture sheet in the conventional development apparatus.

A state where the toner is accumulated on the toner capture sheet 19 in the conventional development apparatus will be described below with reference to the cross-sectional view in FIG. 4. The developer (magnetic brush) on the development sleeve 3 is also illustrated in FIG. 4. As illustrated in FIG. 4, the toner isolated from the developer on the development sleeve 3 is accumulated on the toner capture sheet 19. When the toner layer of the toner accumulating on the toner capture sheet 19 grows to a certain size, the toner layer comes into contact with the magnetic brush on the development sleeve 3 during image forming. In this case, the toner layer of the toner accumulating on the toner capture sheet 19 is scratched as a toner aggregate having a certain size by the magnetic brush, the toner aggregate is directly carried to the photosensitive drum 28, resulting in a defective toner image such as a stain on the image.

The toner layer of the toner accumulating on the toner capture sheet 19 may be collapsed by the influence of an irregular vibration due to the operation of the image forming apparatus 100. If the toner layer of the toner accumulating on the toner capture sheet 19 is collapsed, the toner aggregate drops on the development sleeve 3 or on the magnetic brush on the development sleeve 3. Then, if the toner aggregate is conveyed to the development region together with the magnetic brush and adheres to the electrostatic latent image, a defective image may possibly occur. To prevent the toner accumulating on the toner capture sheet 19 from being used for the development during image forming, it is desirable to collect the toner accumulating on the toner capture sheet 19 during non-image forming.

According to the first exemplary embodiment, a simple configuration enables collecting the toner accumulating on the toner capture sheet 19 during non-image forming. More specifically, the development sleeve 3 is subjected to a reverse rotation operation and then a forward rotation operation during non-image forming. Thus, the image forming apparatus 100 performs a mode (toner collection mode) for efficiently collecting the toner accumulating on the toner capture sheet 19 during non-image forming. This mode will be described in detail below.

Figure 5:
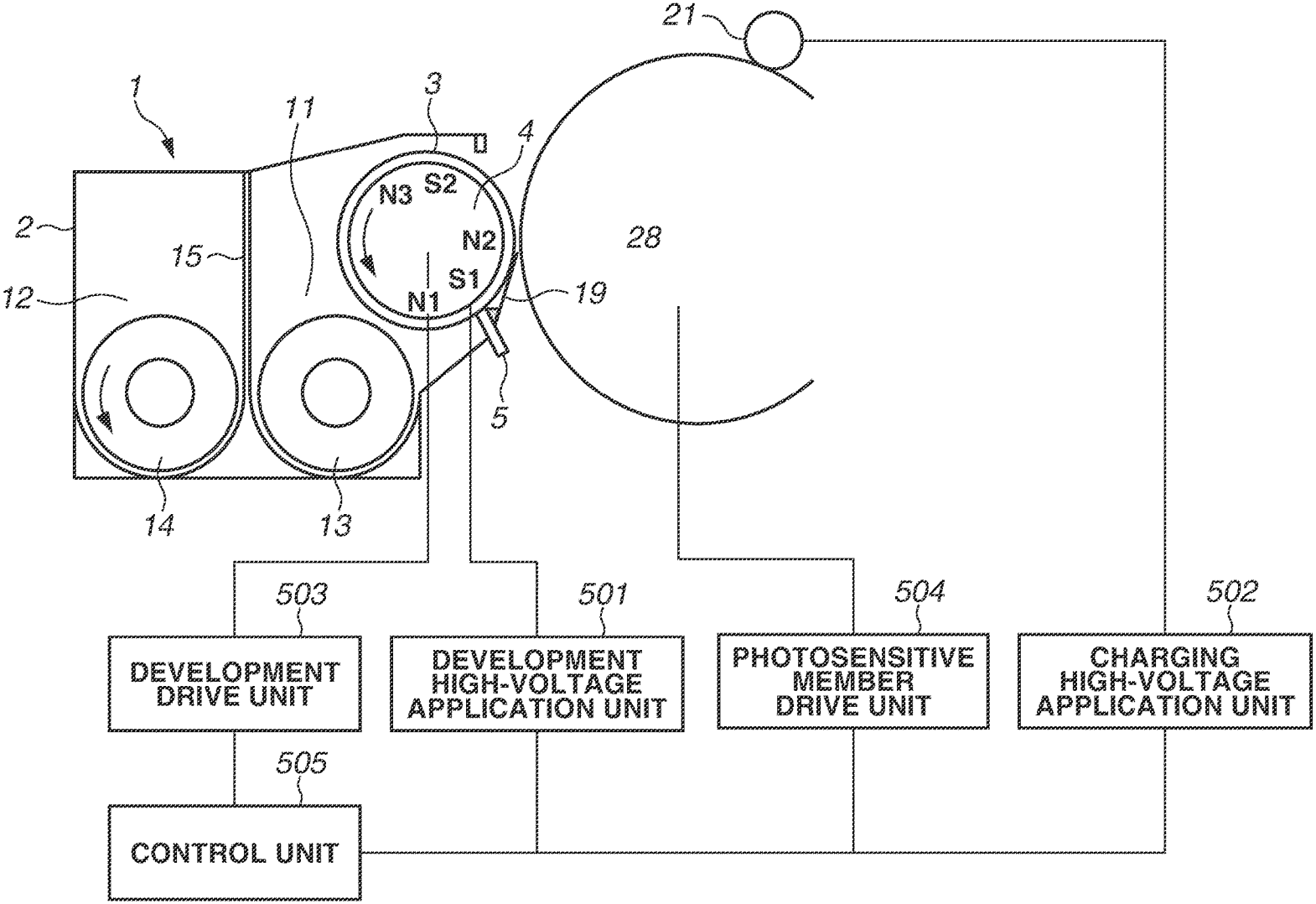
FIG. 5 illustrates a system configuration of the image forming apparatus according to the first exemplary embodiment.

A block diagram for implementing the first exemplary embodiment (a system configuration of the image forming apparatus 100 according to the first exemplary embodiment) will be described below with reference to FIG. 5. The image forming apparatus 100 includes a control unit 505 (central processing unit (CPU)) for controlling a development high-voltage application unit 501, a charging high-voltage application unit 502, a development drive unit 503, and a photosensitive member drive unit 504. The first screw 13, the second screw 14, and the development sleeve 3 are rotatably driven by an identical driving source (the development drive unit 503). The photosensitive drum 28 is rotatably driven by another driving source (the photosensitive member drive unit 504). The development high-voltage application unit 501 for applying a high voltage to the development sleeve 3 is connected to the development sleeve 3. The charging high-voltage application unit 502 for charging the photosensitive drum 28 is connected to a charging roller 21.

A configuration in the vicinity of the toner capture sheet 19 according to the first exemplary embodiment will be described below with reference to the cross-sectional view in FIG. 6. According to the first exemplary embodiment, the regulation blade 5 is disposed below the position where the development sleeve 3 is closest to the photosensitive drum 28, so as to face the development sleeve 3 while being in non-contact with the development sleeve 3, as illustrated in FIG. 6.

Figure 6:
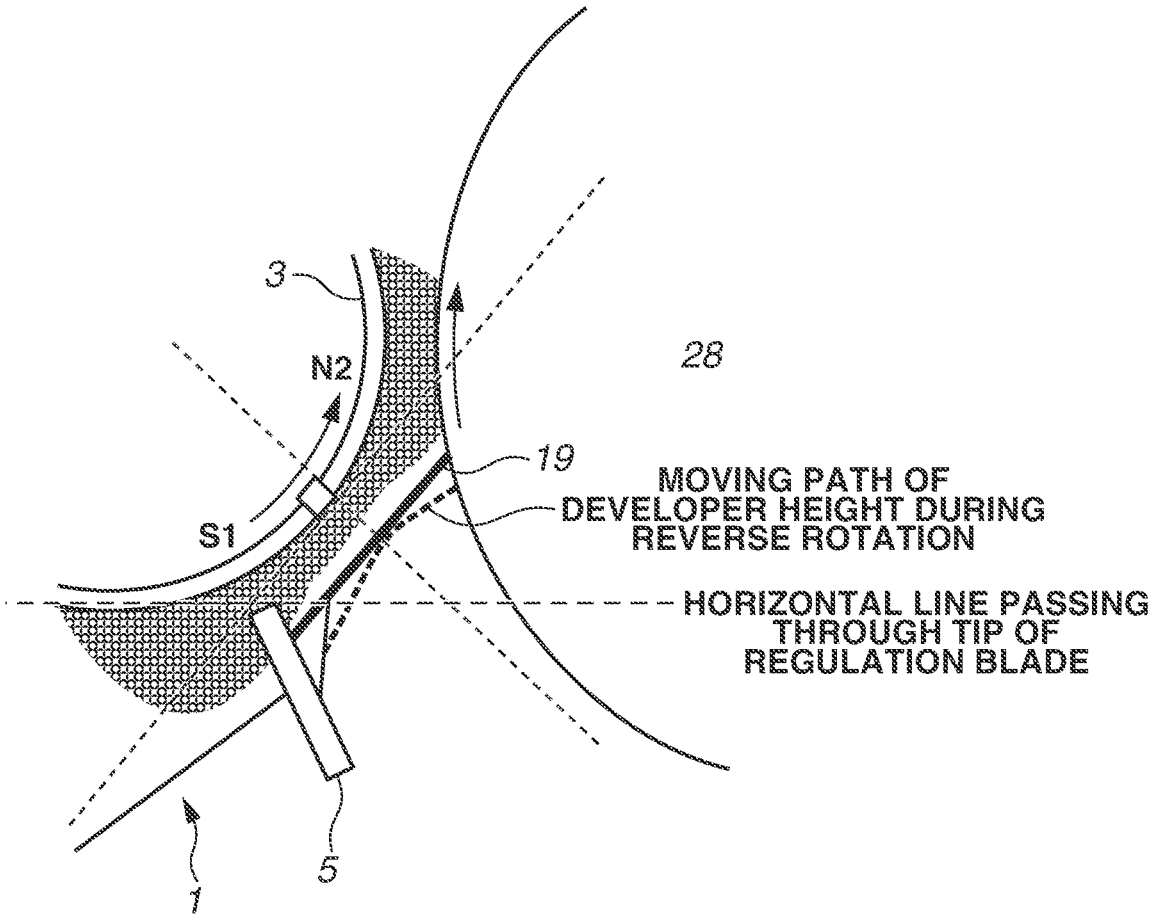
FIG. 6 is a cross-sectional view illustrating a configuration in the vicinity of the toner capture sheet according to the first exemplary embodiment.

According to the first exemplary embodiment, as illustrated in FIG. 6, the toner capture sheet 19 is disposed vertically above the horizon line passing through the tip of the regulation blade 5. The tip of the toner capture sheet 19 is in contact with the photosensitive drum 28. More specifically, the toner capture sheet 19 is disposed below the position where the development sleeve 3 is closest to the photosensitive drum 28, so as to be in contact with the photosensitive drum 28 to block at least a part of the space formed between the development apparatus 1 and the photosensitive drum 28.

The toner capture sheet 19 is disposed more on the side of the development sleeve 3 than the moving path (the moving path of the developer height during the reverse rotation) when the developer on the development sleeve 3 magnetically attracted by the N2 pole (development pole) moves to the regulation blade 5 during the reverse rotation of the development sleeve 3. In other words, the toner capture sheet 19 is disposed in the moving path of the developer when the development sleeve 3 is reversely rotated in the toner collection mode, vertically above the horizontal line passing through the tip of the regulation blade 5.

More specifically, the toner capture sheet 19 is disposed so that the magnetic brush does not come into contact with the toner capture sheet 19 when the development sleeve 3 is forwardly rotated during image forming, and the magnetic brush comes into contact with the toner capture sheet 19 when the development sleeve 3 is reversely rotated during non-image forming.

According to the first exemplary embodiment, in such a configuration of the toner capture sheet 19, the toner accumulating on the toner capture sheet 19 is efficiently collected by reversely rotating the development sleeve 3 during non-image forming. The toner accumulating vertically below the horizontal line passing through the tip of the regulation blade 5 is positioned below the development sleeve 3 in the direction of gravity. Even with insufficient toner collection, there is no possibility that a toner aggregate of the toner accumulating on the toner capture sheet 19 rolls on the development sleeve 3. According to the first exemplary embodiment, therefore, it is necessary to focus attention to collecting the toner accumulating vertically above the horizontal line passing through the tip of the regulation blade 5. Collecting the toner accumulating vertically below the horizontal line passing through the tip of the regulation blade 5 is assumed to be outside the scope of necessary conditions.

Figure 7:
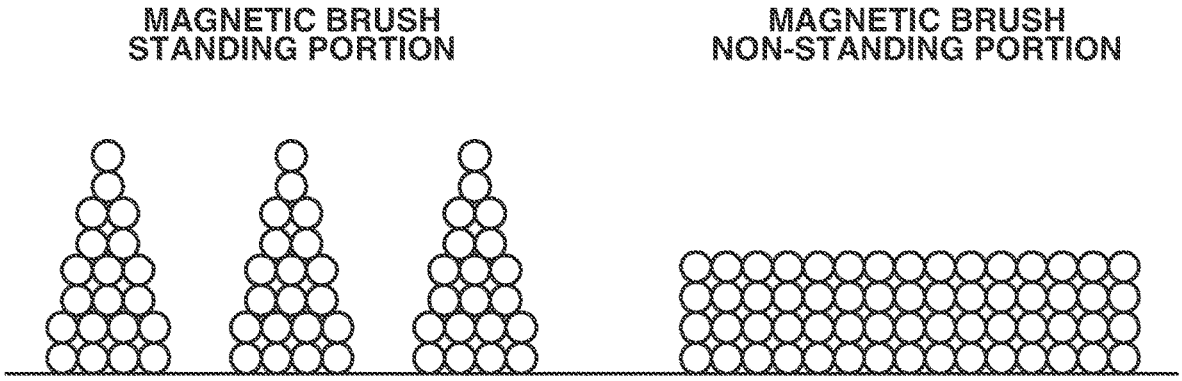
FIG. 7 is a schematic view illustrating a state of a developer on a development sleeve.

A state of the developer on the development sleeve 3 will be described below with reference to the schematic view in FIG. 7. As illustrated in FIG. 7, magnetic brush standing and magnetic brush non-standing portions occur on the development sleeve 3 by the magnetic field generated from the magnet roll 4 fixedly disposed in the development sleeve 3. At the magnetic brush standing portion, the carrier is locally collected by the magnet roll 4 to form a magnetic brush. On the other hand, the magnetic brush non-standing portion where the carrier uniformly exists provides short magnetic brush teeth in comparison with those at the magnetic brush standing portion. Therefore, the moving path of the developer surface on the development sleeve 3 is not in a pure arcuate form but in a curved form as illustrated in FIG. 6. In this case, the point closest to the development sleeve 3 is the magnetic brush non-standing portion where the magnetic field of the magnet roll 4 is weak.

The method for calculating the position of the developer surface at the magnetic brush non-standing portion will be described below. There are calculation methods based on the visualization by using a camera and the amount of the developer on the development sleeve 3. The visualization by using a camera enables analyzing the position of the developer surface by recording the cross-sectional direction of the development sleeve 3 when the development sleeve 3 is reversely rotated at a predetermined speed by using a camera and then performing analysis. On the other hand, the method for calculating the position of the developer surface at the magnetic brush non-standing portion based on the amount of the developer on the development sleeve 3 will be described below. The position of the developer surface indicates the thickness of the developer from the surface of the development sleeve 3. This means that the thickness can be calculated if the amount A of the developer per unit area and the density B of the developer at the magnetic brush non-standing portion are known. The amount of the developer per unit area in the development region can be derived by separating the photosensitive drum 28 after an imaging operation, collecting the developer in a predetermined range by using a magnet, and weighing the developer. Likewise, the density can be derived by measuring the volume of the collected developer. The development region refers to a region where the magnetic brush magnetically stood by the N2 pole of the magnet roll 4 is in contact with the electrostatic latent image on the photosensitive drum 28.

The mode for efficiently collecting the toner accumulating on the toner capture sheet 19 (toner collection mode) during non-image forming will be described in detail below.

In the toner collection mode, the development sleeve 3 is temporarily reversely rotated during non-image forming (e.g., pre-multi-rotation, sheet-to-sheet interval, or post-rotation control). Thus, the developer conveyed to the position of the magnetic pole N2 of the magnet roll 4 (the development pole of the magnet roll 4 disposed in the development region) disposed to face the position where the photosensitive drum 28 is closest to the development sleeve 3 is returned to the surface facing the toner capture sheet 19. By reversely rotating the development sleeve 3, the developer at the position of the magnetic pole N2 (development pole) having a strong magnetic force and a large amount of developer bearing is moved to the position of the regulation blade 5. By reversely rotating the development sleeve 3, a half of the developer at the position of the magnetic pole N2 (development pole) is stemmed by the regulation blade 5 (and the remaining half moves from the SB gap to the inside of the development container 2), thus increasing the amount of the developer at the position facing the toner capture sheet 19.

As described above with reference to FIG. 6, during regular image forming, the magnetic brush does not come into contact with the toner accumulating on the toner capture sheet 19 vertically above the horizontal line passing through the tip of the regulation blade 5. On the other hand, the positional relationship of the toner capture sheet 19 when it is vertically above the horizontal line passing through the tip of the regulation blade 5 is as follows. More specifically, the toner capture sheet 19 is disposed more on the side of the development sleeve 3 than the moving path (the moving path of the developer height during the reverse rotation) when the developer on the development sleeve 3 magnetically attracted by the development pole moves to the regulation blade 5 when the development sleeve 3 is reversely rotated.

When the development sleeve 3 is reversely rotated, the amount of the developer at the position facing the toner capture sheet 19 is increased to allow the contact between the toner accumulating on (adhering to) the toner capture sheet 19 and the magnetic brush, making it possible to remove (collect) the accumulating toner layer. In this case, it is desirable to reversely rotate the development sleeve 3 by 30 to 120 degrees. The reason will be described below.

As described above with reference to FIG. 2, the magnet roll 4 has five different magnetic poles in one circumference. More specifically, the magnet roll 4 is provided with five different magnetic poles: N2 (development pole), S2 (conveyance pole), N3 (stripping pole), N1 (pumping pole), and S1 (regulation pole), starting from N2 at the position where the photosensitive drum 28 is closest to the development sleeve 3 toward the downstream side in the rotational direction of the development sleeve 3. In this case, an interval angle of 40 degrees is formed between the magnetic pole S1 (regulation pole) disposed to face the regulation blade 5 and the magnetic pole N2 (development pole) disposed to face the position where the photosensitive drum 28 is closest to the development sleeve 3.

The toner adhesion portion of the toner capture sheet 19 is positioned on the upstream side of the magnetic pole N2 (development pole) by 30 degrees in the rotational direction of the development sleeve 3. Therefore, the development sleeve 3 needs to be reversely rotated by at least 30 degrees in the toner collection mode.

If the development sleeve 3 is reversely rotated by an angle exceeding 120 degrees in the toner collection mode, even the developer in the vicinity of the region of the magnetic pole S2 (conveyance pole) will be conveyed to the gap at the position where the photosensitive drum 28 is closest to the development sleeve 3. Therefore, an excessive amount of the developer is conveyed by the reverse rotation of the development sleeve 3, possibly resulting in clogging of the developer in the gap between the development sleeve 3 and the photosensitive drum 28. For this reason, to remove the toner accumulating on the toner capture sheet 19 in the toner collection mode, it is desirable to reversely rotate the development sleeve 3 by an angle of 30 to 120 degrees. According to the first exemplary embodiment, the development sleeve 3 is reversely rotated by 60 degrees in the toner collection mode.

On the surface of the developer conveyed on the development sleeve 3, uneven shapes are formed by the magnetic brush. This is the reason why it is hard, in the toner collection mode, to longitudinally and uniformly remove the toner layer accumulating on the toner capture sheet 19 in a set of operations for reversely rotating the development sleeve 3 and then forwardly rotating the development sleeve 3. Thus, in the toner collection mode, performing a set of operations for reversely and forwardly rotating the development sleeve 3 a plurality of times enables improving the effect of removing the toner accumulating on the toner capture sheet 19.

If the accumulating toner removed in the toner collection mode is captured into the development container 2, carried in the development chamber 11, and then supplied again to the development region in an aggregated state, a defective image may possibly occur. To prevent this, the first exemplary embodiment sets the surface potential of the photosensitive drum 28 to 0 V when the development sleeve 3 is reversely rotated and then forwardly rotated during non-image forming. Then, a potential of about −20 V is applied to the surface of the development sleeve 3 to generate an analog development state. This enables discharging the scratched accumulating toner onto the photosensitive drum 28, preventing a defective image due to a toner aggregate.

The potential setting is not limited to the analog development state. The accumulating toner may be discharged by using a digital latent image. However, when discharging the accumulating toner by using a digital latent image, the time until the latent image reaches the development region is required in comparison with the analog development, resulting in a prolonged downtime. Therefore, from the viewpoint of shortening the downtime, it is desirable to use the analog development rather than the digital development.

(Example of Toner Collection Mode Control)

Figure 8:
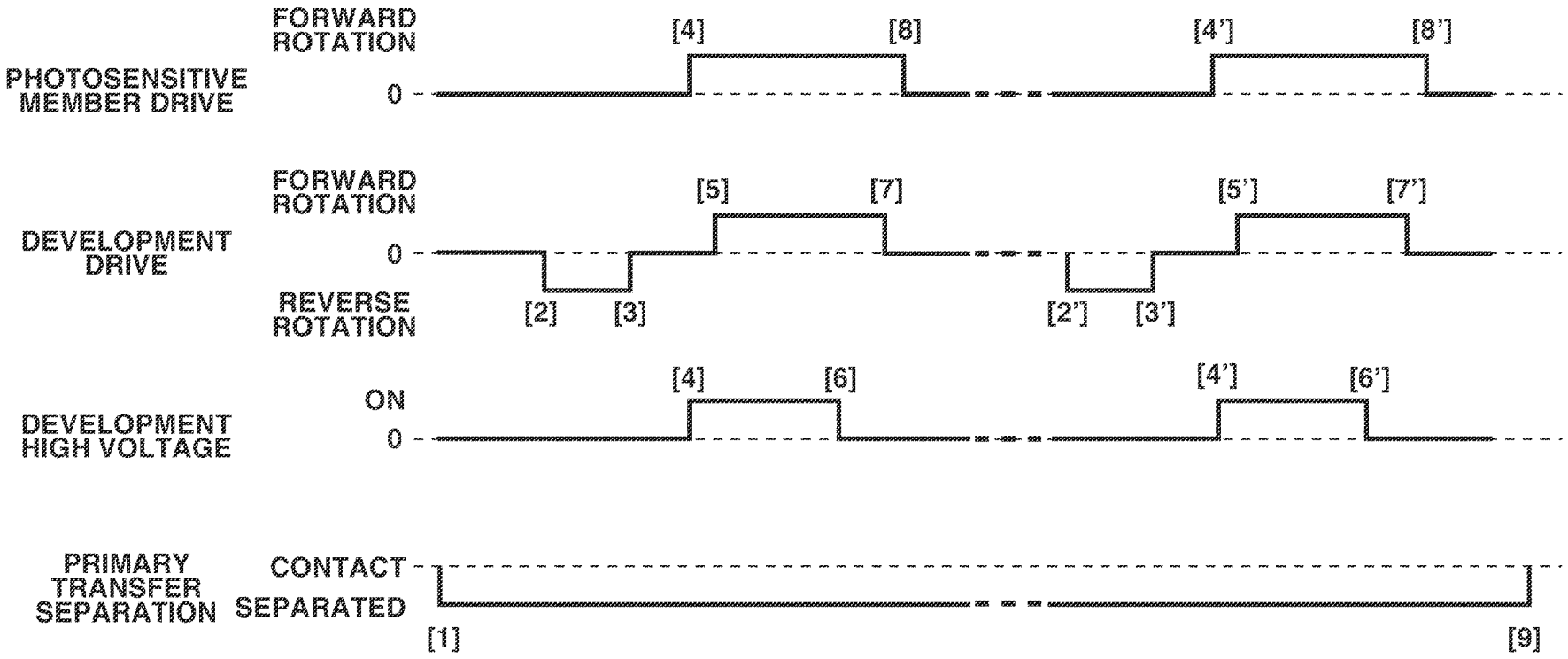
FIG. 8 is a sequence diagram illustrating an example control of a toner collection mode according to the first exemplary embodiment.
Figure 9:
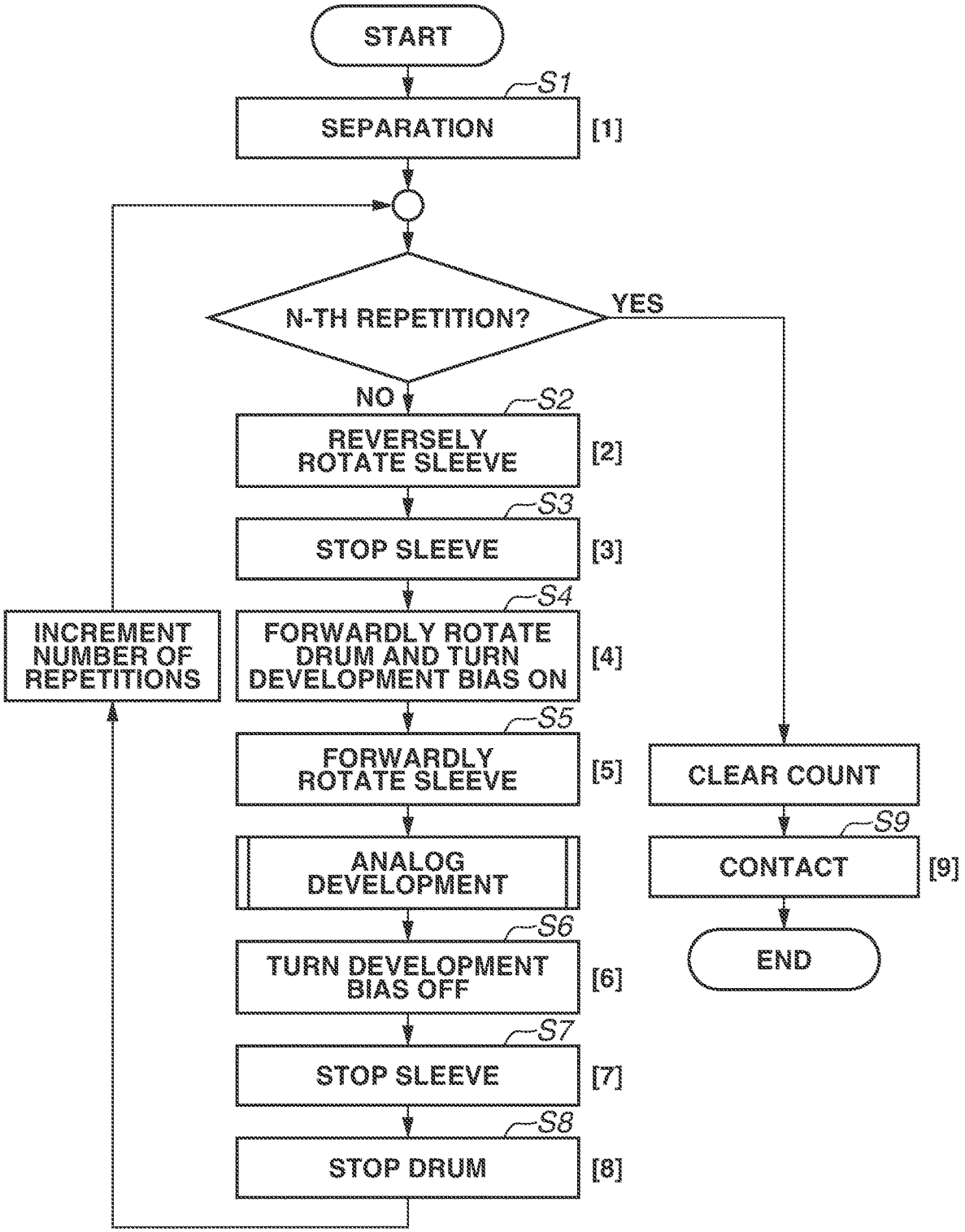
FIG. 9 is a flowchart illustrating an example control of the toner collection mode according to the first exemplary embodiment.

An example control of the toner collection mode according to the first exemplary embodiment will be described below with reference to the sequence diagram in FIG. 8. Control operations corresponding to the sequence diagram in FIG. 8 will be described below with reference to the flowchart in FIG. 9. Control operations in FIGS. 8 and 9 are implemented when the control unit 505 (CPU) reads a control program stored in a storage medium of the image forming apparatus 100 and then controls the development high-voltage application unit 501, the charging high-voltage application unit 502, the development drive unit 503, and the photosensitive member drive unit 504. The control flow in FIG. 9 is started when the control unit 505 (CPU) determines that a toner collection mode execution condition (described below with reference to FIG. 10) is satisfied.

[1]: Separate the photosensitive drum 28 for each color from the intermediate transfer member 24 (primarily transfer separation) (step S1).

[2]: Start the development drive for the rotation by 60 degrees in the direction opposite to the normal rotational direction. In this case, the control unit 505 starts collecting the toner accumulating on the toner capture sheet 19 by using a magnetic brush (step S2).

[3]: Move the developer in the development region to the vicinity of the regulation blade 5 and then stop the development drive (step S3). In this state, the magnetic brush is stagnated by the regulation blade 5, and a large amount of the toner collected from the toner capture sheet 19 adheres to the surface of the magnetic brush.

[4]: Start rotating the photosensitive drum 28 in a rotational direction same as that during the regular imaging operation and, at the same time, apply (turn ON) the development high voltage (step S4).

[5]: Start the development drive in a rotational direction same as that during the regular imaging operation (step S5). In this case, the tip of the magnetic brush scratches and collects the toner accumulating on the toner capture sheet 19. The collected toner is discharged onto the photosensitive drum 28 by the force of the electric field.

[6], [7], and [8]: Stop the development high voltage, the development drive, and the photosensitive drum drive in this order (steps S6, S7, and S8).

Assuming that a series of the processes in steps S2 to S8 is one set, the control unit 505 further performs four sets of a series of the processes in steps S2 to S8, i.e., the control unit 505 performs five sets in total. Since the shape of the magnetic brush changes at random, performing five sets of a series of the processes in steps S2 to S8 enables more efficiently collecting the toner on the toner capture sheet 19 than performing only one set of a series of the processes.

When the control unit 505 has performed a total of five sets of a series of the processes in steps S2 to S8, the processing proceeds to step S9.

[9]: Change the state where the intermediate transfer member 24 is separated from the photosensitive drum 28 to the state where the intermediate transfer member 24 is in contact with the photosensitive drum 28 (step S9).

Figure 10:
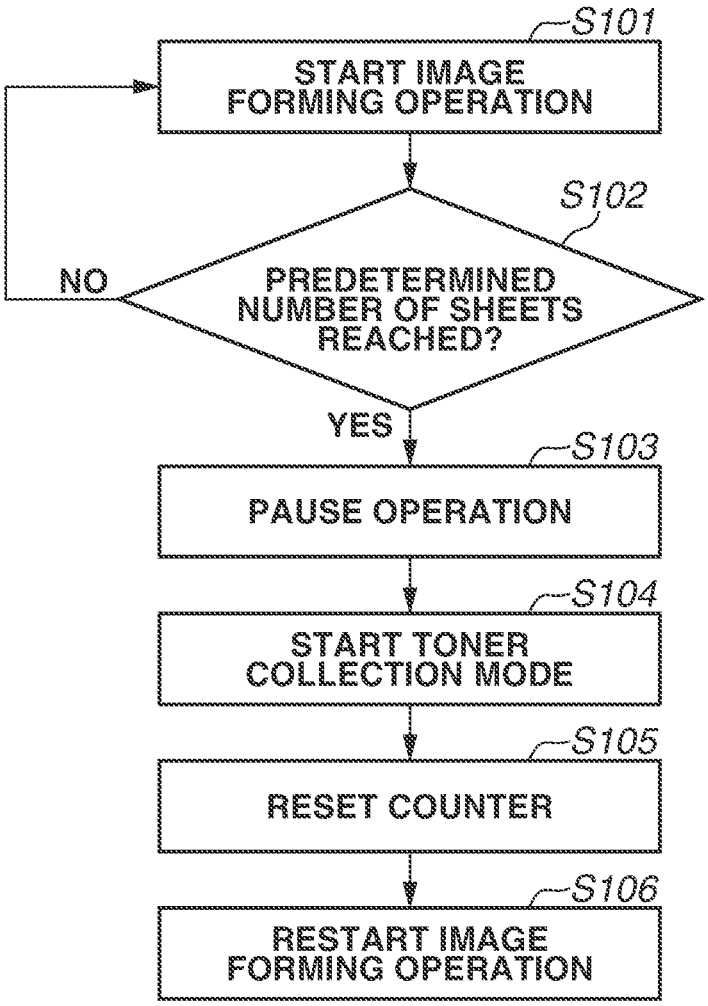
FIG. 10 is a flowchart illustrating a trigger for performing the toner collection mode.

Performing the above-described processing in steps S1 to S9 (toner collection mode) enables collecting and removing the toner accumulating on the toner capture sheet 19. A trigger for performing the processing in steps S1 to S9 (toner collection mode) (i.e., toner collection mode execution condition) will be described below with reference to the flowchart in FIG. 10. Control operations in FIG. 10 are implemented when the control unit 505 (CPU) reads a control program stored in the storage medium of the image forming apparatus 100 and then controls various apparatuses.

In step S101, the control unit 505 starts the image forming operation. After last performing the processing in steps S1 to S9 in FIG. 9 (toner collection mode), then in step S102, the control unit 505 determines whether a predetermined number of recording material sheets have been subjected to image forming. The predetermined number of sheets is suitably changed in consideration of the toner accumulation state on the toner capture sheet 19 according to the temperature and humidity conditions and the image density. When the predetermined number of sheets is not reached (NO in step S102), the control unit 505 continues image forming. When the predetermined number of sheets is reached (YES in step S102), the processing proceeds to step S103. In step S103, the control unit 505 pauses the image forming operation. In step S104, the control unit 505 starts the processing in steps S1 to S9 in FIG. 9 (toner collection mode). Upon completion of the processing in steps S1 to S9 in FIG. 9 (toner collection mode), the processing proceeds to step S105. In step S105, the control unit 505 resets the counter for performing the toner collection mode (the number of recording material sheets that have been subjected to image forming) to zero. In step S106, the control unit 505 restarts the image forming operation.

It is desirable that the counter for performing the toner collection mode is provided for full color and black (K), or for each color. This is because there are a number of models having the black (K) monochrome mode in which image forming is performed by separating the yellow (Y), magenta (M), and cyan (C) photosensitive drums 28 from the intermediate transfer member 24.

Effects of the toner collection mode according to the first exemplary embodiment will be described below with reference to FIGS. 11 to 14.

We compared the configuration according to the first exemplary embodiment with the configuration according to the conventional example in terms of the frequency of stained image occurrences due to the toner accumulating on the toner capture sheet 19.

In the configuration according to the conventional example, the toner capture sheet 19 is separated from the development sleeve 3 by 1 mm or around, and the sequence of the processing in steps S1 to S9 in FIG. 9 (toner collection mode) is not included.

On the other hand, the configuration according to the first exemplary embodiment includes the above-described configuration of the toner capture sheet 19 in FIG. 6. More specifically, the toner capture sheet 19 is disposed so that the magnetic brush does not come into contact with the toner capture sheet 19 when the development sleeve 3 is forwardly rotated during image forming, and the magnetic brush comes into contact with toner capture sheet 19 when the development sleeve 3 is reversely rotated during non-image forming. The first exemplary embodiment further includes a configuration for performing the processing in steps S1 to S9 in FIG. 9 (toner collection mode) in addition to the above-described configuration of the toner capture sheet 19.

The condition under which a large amount of toner is consumed and replenished in a high temperature high humidity environment where the charge amount of toner is low also serves as the condition under which the largest amount of toner accumulates. Therefore, the comparison is made based on a result of continuous image forming with an image area ratio (average image duty) of 25% in a 30° C. temperature 80% humidity environment. Since a stained image due to the toner accumulating on the toner capture sheet 19 appears as a dark streak-like image, we performed evaluation by using magenta and cyan halftone images in the first exemplary embodiment.

According to the first exemplary embodiment, we classified stains into three different categories: level 1 with a stain length of less than 10 mm, level 2 with a stain length of 10 mm or more and less than 30 mm, and level 3 with a stain length of 30 mm or more, performed image printing on 5,000 sheets, and counted the number of stains for each level. The result of converting the count into the number of occurrences per 500 sheets is illustrated in FIG. 11.

In the configuration according to the first exemplary embodiment, the frequency of defective image occurrences can be reduced to about 40% of that in the configuration according to the conventional example.

Figure 12:
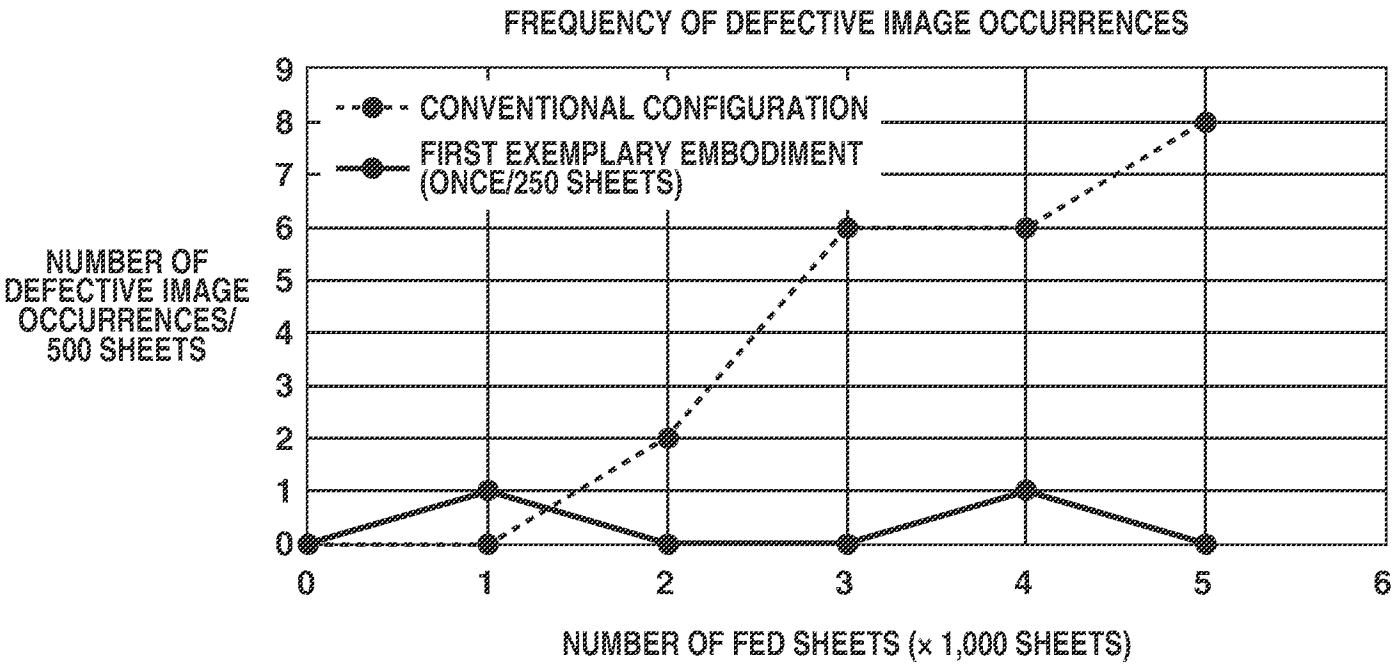
FIG. 12 illustrates effects of the toner collection mode according to the first exemplary embodiment.

As described above, in the configuration according to the conventional example, the toner capture sheet 19 is separated from the development sleeve 3 by 1 mm or around, and the sequence of the processing in steps S1 to S9 in FIG. 9 (toner collection mode) is not included. On the other hand, the configuration according to the first exemplary embodiment includes the configuration of the toner capture sheet 19 described above with reference to FIG. 6, and performs the processing in steps S1 to S9 in FIG. 9 (toner collection mode) once for 250 A4 one-sided sheets. To compare the configuration according to the conventional example with the configuration according to the first exemplary embodiment, we continuously fed sheets with a high-density image having an image area ratio (average image duty) of 25% with respect to A4 one-sided recording materials and then counted the number of stained images occurring per 500 sheets. The result of the comparison is illustrated in FIG. 12.

In the configuration according to the conventional example, no stained image was observed for up to 1,000 sheets, and the frequency of defective image occurrences increased after image printing on 2,000 sheets. For up to 2,000 sheets, the toner accumulates on the toner capture sheet 19 not to the extent that the toner comes into contact with the magnetic brush during the imaging operation, and hence the toner layer is not crushed. However, after printing on 2,000 sheets, the thickness of the toner layer increases to an extent that the toner comes into contact with the magnetic brush, increasing the possibility that the toner aggregate crushed by the magnetic brush appears as a stain in an image. On the other hand, in the configuration according to the first exemplary embodiment as illustrated in FIG. 12, the frequency of stain occurrences is approximately constant even with an increase in the number of fed sheets.

Changes of quality items by the sheet length of the toner capture sheet 19 are illustrated in FIG. 13. In a state (case 3)

where the tip of the toner capture sheet 19 enters the development region, the toner capture sheet 19 is caught between the development sleeve 3 and the photosensitive drum 28 and pressed onto the photosensitive drum 28. The heat generated at this timing poses an issue that the toner fuses and bonds to the photosensitive drum 28.

On the contrary, if the sheet length of the toner capture sheet 19 is too short, the tip of the toner capture sheet 19 does not come into contact with the photosensitive drum 28 (case 1), and hence, the toner capture sheet 19 becomes unable to sufficiently capture the toner scattered from the development sleeve 3. As a result, the toner will be scattered out of the development apparatus 1 (within the image forming apparatus 100). On the other hand, in a state (case 2) where only the tip of the toner capture sheet 19 is in contact with the photosensitive drum 28, a stain occurs only with the forward rotation of the development sleeve 3. Stains can be improved by performing a reverse rotation sequence of the development sleeve 3 in the toner collection mode.

The length of the magnetic brush in the magnetic brush standing portion will be described below. Dominant factors that control the length of the magnetic brush include the amount of the developer per unit area on the development sleeve 3, the magnetic flux density at the N2 pole (development pole) of the magnet roll 4, the particle diameter of the carrier, and the magnetization level of the carrier. When measuring the length of the magnetic brush, we observed the developer on the development sleeve 3 by using an optical microscope (VR3000 from KEYENCE). Firstly, we drove the development apparatus 1 for 10 seconds by using an apparatus capable of solely driving the development apparatus 1, observed the developer on the development sleeve 3 by using the microscope, and obtained the average value of the maximum length of each magnetic brush in an observation range (10 mm×10 mm) as the length of the magnetic brush.

In the development apparatus 1 having the configuration according to the first exemplary embodiment, the N2 pole (development pole) of the magnet roll 4 has a magnetic flux density of 1050 G and a half-value width of 42 degrees. The developer has a carrier particle diameter of 40 μm and a carrier magnetization level of 190 emu/cm$^3$. Under these conditions, we measured the length of the magnetic brush while varying the amount of the developer per unit area on the development sleeve 3 to 20, 30, 40, and 50 mg/cm$^2$. Results of this measurement are illustrated in FIG. 14.

According to the first exemplary embodiment, the amount of the developer per unit area on the development sleeve 3 was 30 mg/cm$^2$ during the forward rotation of the development sleeve 3, and 50 mg/cm$^2$ during the reverse rotation of the development sleeve 3. The amount of the developer on the development sleeve 3 is 30 mg/cm$^2$ which is regularly determined by the regulation blade 5. However, when the developer passes through the development region between the development sleeve 3 and the photosensitive drum 28, the developer is stagnated because of the small gap therebetween, resulting in a local increase in the amount of the developer. Therefore, at the time of the reverse rotation, the amount of the developer is 50 mg/cm$^2$ because of the developer stagnation.

Figure 14:
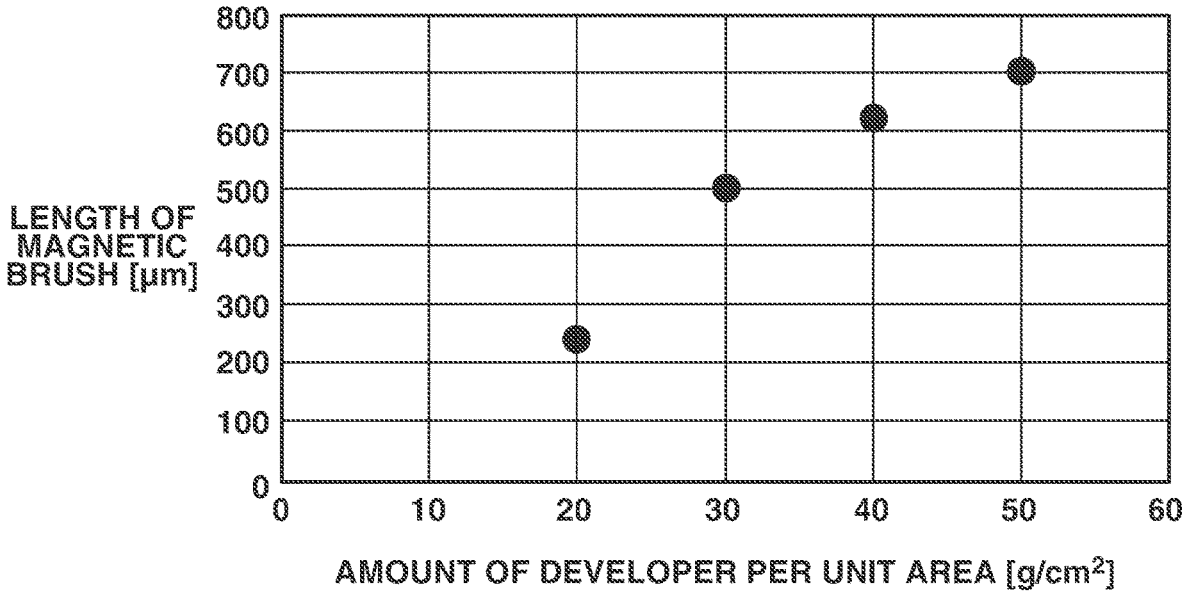
FIG. 14 illustrates effects of the toner collection mode according to the first exemplary embodiment.

As illustrated in FIG. 14, the length of the magnetic brush is 500 μm when the amount of the developer is 30 mg/cm$^2$ (during the forward rotation of the development sleeve 3), or 700 μm when the amount of the developer is 50 mg/cm$^2$ (during the reverse rotation of the development sleeve 3).

As described above, the first exemplary embodiment has the following configuration. The toner capture sheet 19 is disposed so that the magnetic brush does not come into contact with the toner capture sheet 19 when the development sleeve 3 is forwardly rotated during image forming, and the magnetic brush comes into contact with toner capture sheet 19 when the development sleeve 3 is reversely rotated during non-image forming. The first exemplary embodiment further includes a configuration for performing the processing in steps S1 to S9 in FIG. 9 (toner collection mode) in addition to the above-described configuration of the toner capture sheet 19.

According to the first exemplary embodiment, when the development sleeve 3 is reversely rotated in the toner collection mode, the developer in the development region can be brought into contact with the toner on the toner capture sheet 19, making it possible to efficiently collect the toner accumulating on the toner capture sheet 19. Thus, according to the first exemplary embodiment, a magnetic field generation member such as an electromagnet does not need to be provided in the space ranging from the development region downward in the direction of gravity. This eliminates the need of providing a space for disposing an electromagnet in addition to the toner capture sheet 19 in the space ranging from the development region downward in the direction of gravity. Such a simple configuration according to the first exemplary embodiment enables collecting the toner accumulating on the toner capture sheet 19 during non-image forming.

A second exemplary embodiment will be described below. The image forming process according to the second exemplary embodiment is approximately identical to that according to the first exemplary embodiment, and redundant descriptions thereof will be suitably omitted. The second exemplary embodiment has the same hardware configuration as the first exemplary embodiment, and differs from the first exemplary embodiment only in the sequence of the toner collection mode. Therefore, the descriptions of the hardware configuration will be omitted. The second exemplary embodiment will be described below centering only on the difference, i.e., the sequence of the toner collection mode.

Figure 15:
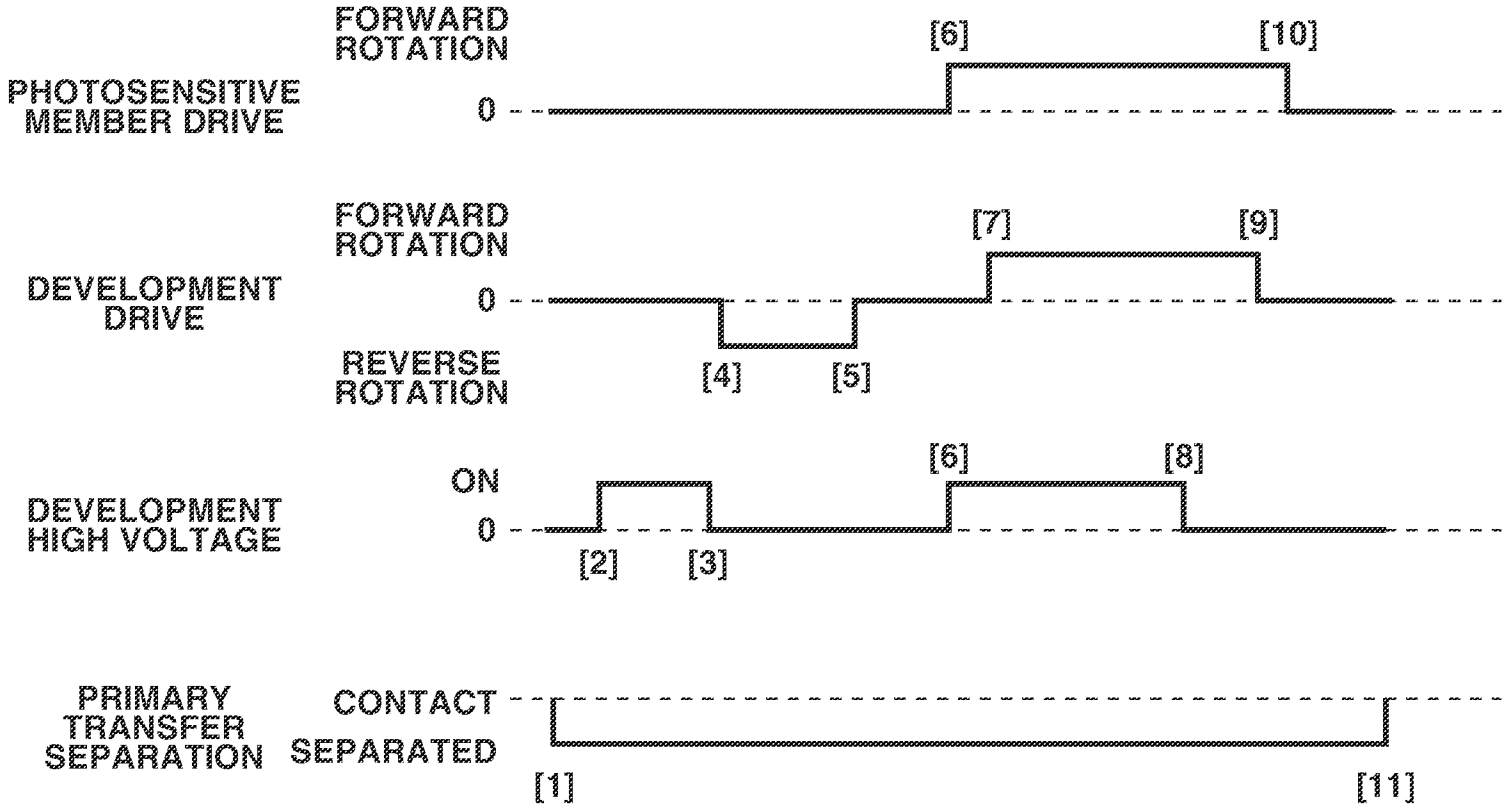
FIG. 15 is a sequence diagram illustrating an example control of a toner collection mode according to a second exemplary embodiment.

An example control of the toner collection mode according to the second exemplary embodiment will be described below with reference to the sequence diagram in FIG. 15.

[1]: Separate the photosensitive drum 28 from the intermediate transfer member 24 (separation in the primarily transfer).

[2]: Apply only the development high voltage. In this case, the photosensitive drum 28 is not charged and therefore provides a surface potential of about 0 V. The control unit 505 applies the +200 V development high voltage. Thus, the toner in the development region is moved onto the photosensitive drum 28 by the electric field. As a result, the developer in the development region enters a carrier rich state where a small amount of toner exists.

[3]: Stop (turn OFF) the development high voltage.

[4]: Start the development drive for the rotation in the opposite direction of the normal rotational direction. At this timing, the control unit 505 starts collecting the toner accumulating on the toner capture sheet 19 by using the magnetic brush.

[5]: Move the developer in the development region to the vicinity of the regulation blade 5 and then stop the development drive. At this timing, a large amount of the toner collected from the toner capture sheet 19 adheres to the magnetic brush.

The toner is collected by the magnetic brush in the developer in a carrier rich state through the operation [2], improving the efficiency of the toner collection.

[6]: Start rotating the photosensitive drum 28 in a rotational direction same as that during the regular image forming, and turn the development high voltage ON at the same time.

[7]: Start the development drive in a direction same as that during the regular imaging operation. The toner collected by the tip of the magnetic brush is discharged onto the photosensitive drum 28 by the force of the electric field.

[8], [9], and [10]: Stop the development high voltage, the development drive, and the photosensitive member drive in this order.

[11]: Change the state where the intermediate transfer member 24 is separated from the photosensitive drum 28 to the state where the intermediate transfer member 24 is in contact with the photosensitive drum 28.

According to the second exemplary embodiment, unlike the first exemplary embodiment, time periods (operations [1] and [2]) for applying only the development high voltage are provided before the operation [3] that starts rotating the development drive in the direction opposite to the normal rotational direction in the sequence of the toner collection mode. The toner is collected by the magnetic brush in the developer in a carrier rich state, improving the efficiency of the toner collection.

Figure 16:
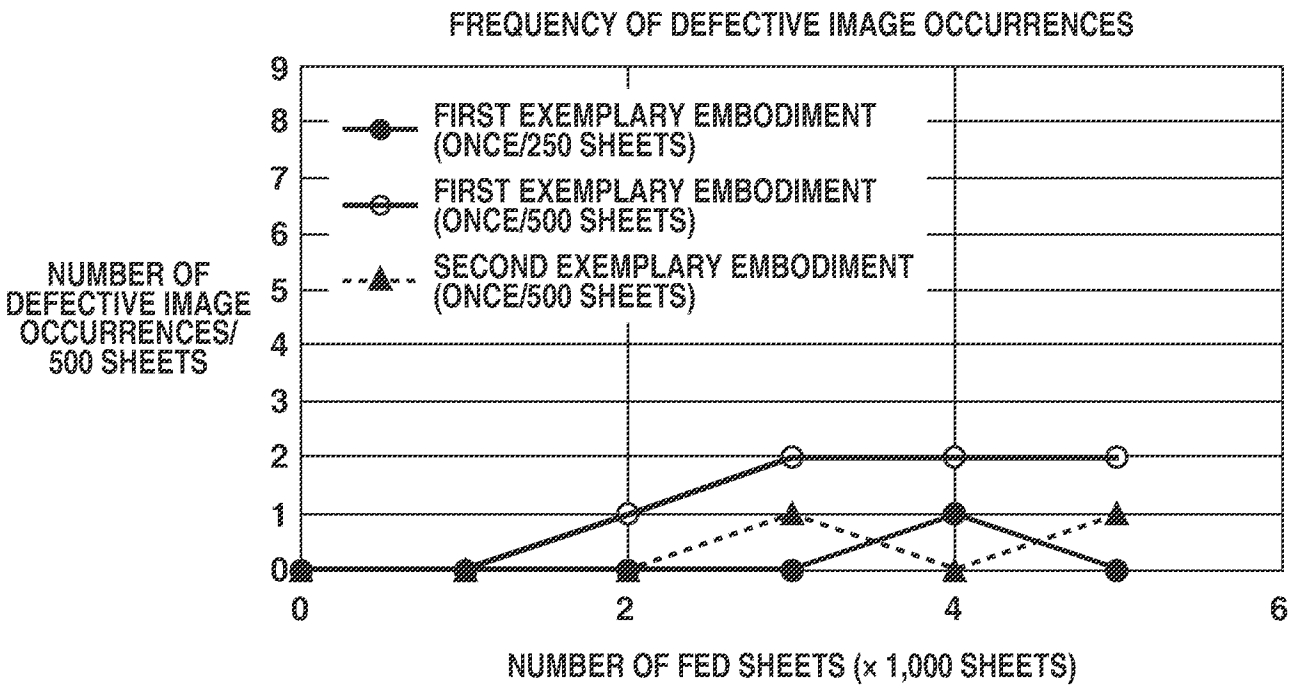
FIG. 16 illustrates effects of the toner collection mode according to the second exemplary embodiment.

Effects of the toner collection mode according to the second exemplary embodiment will be described below with reference to FIG. 16.

According to the second exemplary embodiment, the toner collection mode is performed when 250 recording material sheets have been subjected to image forming since the toner collection mode was last performed. This means that the toner collection mode is performed once for 250 sheets. If the toner collection mode is performed once for 500 sheets from the viewpoint of the productivity improvement (downtime reduction) in the sequence of the toner collection mode according to the first exemplary embodiment, a high frequency of stained image occurrences will result, as illustrated in FIG. 16. This is due to the limited amount to toner to be collected out of the toner accumulating on the toner capture sheet 19 in the sequence of the toner collection mode according to the first exemplary embodiment.

On the other hand, even if the toner collection mode is performed once for 500 sheets in the sequence of the toner collection mode according to the second exemplary embodiment, it is possible to obtain effects similar to those in the toner collection mode performed once for 250 sheets in the sequence of the toner collection mode according to the first exemplary embodiment. Thus, the second exemplary embodiment can be said to be more advantageous than the first exemplary embodiment in that the effects of the productivity improvement (downtime reduction) can be obtained while maintaining the effects of the toner collection mode.

A third exemplary embodiment will be described below. The image forming process according to the third exemplary embodiment is approximately identical to that according to the first exemplary embodiment, and redundant descriptions thereof will be suitably omitted. The third exemplary embodiment has the same hardware configuration as the first exemplary embodiment, and differs from the first exemplary embodiment only in the sequence of the toner collection mode. Therefore, the descriptions of the hardware configuration will be omitted. The third exemplary embodiment will be described below centering only on the difference, i.e., the sequence of the toner collection mode.

Figure 17:
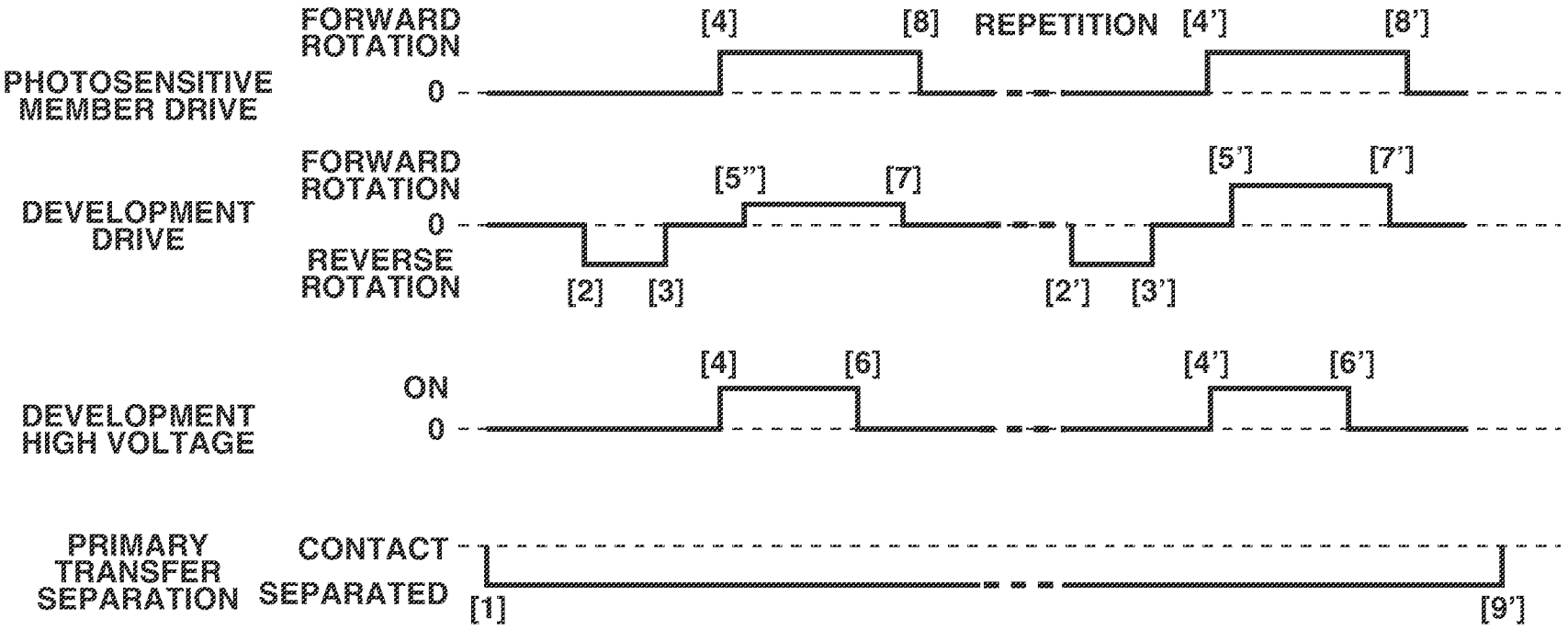
FIG. 17 is a sequence diagram illustrating an example control of a toner collection mode according to a third exemplary embodiment.

The third exemplary embodiment differs from the first exemplary embodiment in the forward rotation operation after the reverse rotation of the development sleeve 3 in the toner collection mode. An example control of the toner collection mode according to the third exemplary embodiment will be described below with reference to the sequence diagram in FIG. 17.

The toner collection mode according to the third exemplary embodiment differs from the toner collection mode (the sequence from [1] to [9]) according to the first exemplary embodiment in that the sequence [5] has changed to [5']. More specifically, the sequence [5'] according to the third exemplary embodiment differs from the sequence [5] according to the first exemplary embodiment in that the driving speed of the development sleeve 3 is decreased when performing the development drive in a direction same as that during the regular imaging operation. Decreasing the driving speed of the development sleeve 3 increases the loaded amount of the developer on the development sleeve 3 (M/S) to increase the thickness from the surface of the development sleeve 3. This enables scratching a larger amount of the toner accumulating on the toner capture sheet 19.

Figure 18:
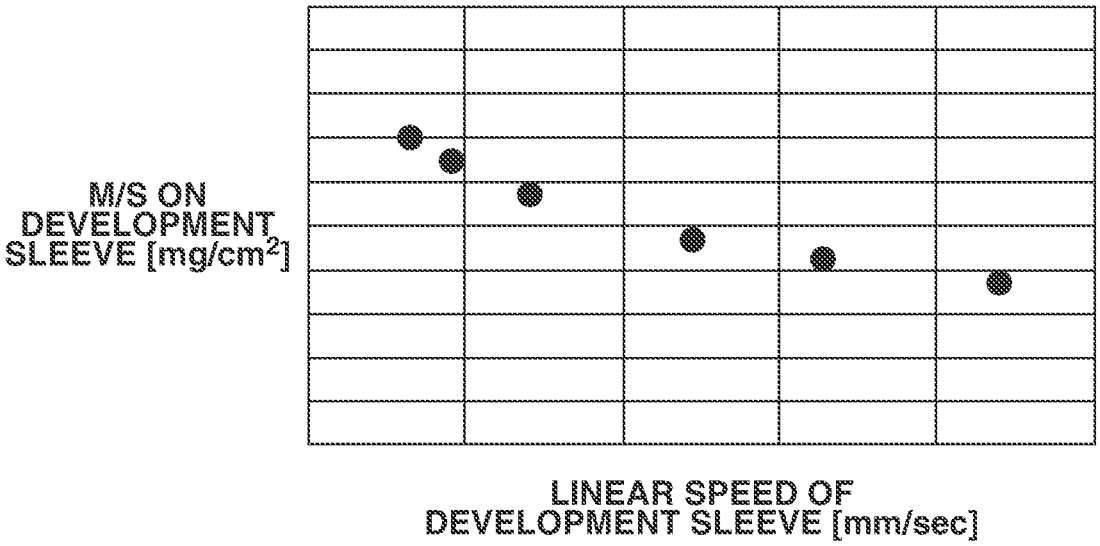
FIG. 18 illustrates a relation between the amount of coat on the development sleeve and a linear speed.

The relation between the driving speed of the development apparatus 1 and the loaded amount of the developer (M/S) per unit area when the development sleeve 3 is coated with a thin layer (the relation between the amount of developer coating on the development sleeve 3 and the linear speed) will be described below with reference to FIG. 18.

When the configuration of the magnetic pole of the magnet roll 4 is identical, the amount of developer coating on the development sleeve 3 changes according to the rotational speed of the development sleeve 3. When the development sleeve 3 is rotating at a high rotational speed, the magnetic brush quickly stands by the centrifugal force, and hence the magnetic brush is cut by the regulation blade 5 in a state where the magnetic brush stands to a further extent. Therefore, when the development sleeve 3 is rotating at a high speed, the amount of developer coating after passing through the gap (SB gap) between the development sleeve 3 and the regulation blade 5 tends to decrease. On the other hand, when the development sleeve 3 is rotating at a low speed, the magnetic brush slowly stands because of a small centrifugal force, and the magnetic brush passes the regulation blade 5 in a less standing state than in a state where the development sleeve 3 is rotating at a high speed. Therefore, when the development sleeve 3 is rotating at a low speed, the loaded amount of the developer (M/S) on the development sleeve 3 after passing through the SB gap increases, and the magnetic brush tends to become higher.

Decreasing the rotational speed of the development sleeve 3 to increase the amount of the developer passing through the SB gap increases the height of the magnetic brush in the developer at the position facing the toner capture sheet 19. More specifically, when the development sleeve 3 is rotating at a low speed, a larger amount of the magnetic brush comes into contact with the toner accumulating on the toner capture sheet 19, achieving a higher efficiency of collecting the toner on the toner capture sheet 19, than in a case where the development sleeve 3 is rotating at a high speed. In the toner collection mode according to the third exemplary embodiment, by reversely rotating the development sleeve 3 and then forwardly rotating the development sleeve 3 at a low speed in the forward rotation operation, the toner on the toner capture sheet 19 can be more efficiently collected than in the configuration according to the first exemplary embodiment.

During the forward rotation operation after the reverse rotation of the development sleeve 3 in the toner collection mode, control can be easily performed if the rotational speed of the development sleeve 3 is set to the lowest control speed of the image forming apparatus 100. For example, the linear speed setting corresponding to the image forming speed for thick paper is often a half of the linear speed setting for plain paper. This linear speed setting can also be used in the forward rotation operation after the reverse rotation of the development sleeve 3 in the toner collection mode. Rotating the development sleeve 3 at a lower speed increases the loaded amount of the developer (M/S) on the development sleeve 3 to a further extent.

Therefore, when performing the sequence of the toner collection mode according to the third exemplary embodiment, the rotational speed is not limited to the example speed but control may be performed at a lower speed. When a set of the combination of the reverse and the forward rotations of the development sleeve 3 is repeated a plurality of times, it is desirable to return the linear speed for the forward rotation to the regular linear speed to enable shifting to the following imaging forming operation immediately after the last forward rotation.

The effect of collecting the toner on the toner capture sheet 19 can also be improved by increasing the number of repetitions of a series of operations for reversely rotating and then forwardly rotating the development sleeve 3 in the toner collection mode. This is due to the toner layer breakdown occurring when the toner accumulating on the toner capture sheet 19 is scratched, or the accumulated toner exceeding the tolerance of the toner mount that can be born on the magnetic brush surface. Possible causes of these issues include the fact that, if uneven scratching occurs because of the uneven shape of the magnetic brush or if the amount of the toner accumulation is large with respect to the superficial area of the magnetic brush, the toner cannot be sufficiently removed only by reversely rotating the development sleeve 3.

Effects of the toner collection mode according to the third exemplary embodiment will be described below with reference to FIG. 19. More specifically, FIG. 19 illustrates the result of the comparison of the frequency of stained image occurrences when reversely rotating the development sleeve 3 and then forwardly rotating the development sleeve 3 at a low speed during the forward rotation operation in the toner collection mode. FIG. 19 illustrates the comparison of the frequency of stained image occurrences through continuous image forming with an image area ratio of 25% in a 30° C. temperature 80% humidity environment, like the first exemplary embodiment.

According to the configuration according to the third exemplary embodiment, the frequency of defective image occurrences can be reduced by about 80% in comparison with the configuration according to the conventional example by reversely rotating the development sleeve 3 and then forwardly rotating the development sleeve 3 at a low speed during the forward rotation operation in the toner collection mode. In addition, the frequency of defective image occurrences can be reduced by about 90% in comparison with the configuration according to the conventional example by increasing the number of repetitions of a series of operations for reversely rotating and then forwardly rotating the development sleeve 3 in the toner collection mode from three (second exemplary embodiment A) to five (second exemplary embodiment B).

Other Exemplary Embodiments

The present disclosure is not limited to the above-described exemplary embodiments and can be modified in diverse ways (including organic combinations of these exemplary embodiments) without departing from the spirit and scope thereof. These modifications are not excluded from the scope of the present disclosure.

In the above-described exemplary embodiments, there has been described an example where the toner collection mode is performed during non-image forming (e.g., pre-multi-rotation, sheet-to-sheet interval, or post-rotation control). As a toner collection mode execution condition, there has been described an example where the toner collection mode is performed when a predetermined number of recording material sheets have been subjected to image forming since the toner collection mode was last performed. A modification where the toner collection mode execution condition is differentiated among pre-multi-rotation, sheet-to-sheet interval, and post-rotation control is also applicable.

For example, the number of sheets subjected to image forming as a trigger for performing the toner collection mode (the number of recording material sheets that have been subjected to image forming since the toner collection mode was last performed) may be differentiated between a case where the toner collection mode is performed during the sheet-to-sheet interval and a case where the toner collection mode is performed during the post-rotation control. Assume an example case where the productivity is intended to be given priority (the downtime is intended to be restricted). In this case, the toner collection mode is performed during the sheet-to-sheet interval when 500 recording material sheets have been subjected to image forming since the toner collection mode was last performed. Assume another example case where the frequency of performing the toner collection mode is intended to be increased during the post-rotation control in comparison with the sheet-to-sheet interval. In this case, the toner collection mode is performed during the post-rotation control when 250 recording material sheets have been subjected to image forming since the toner collection mode was last performed.

Assume still another example case where the toner collection mode is intended to be performed during the pre-multi-rotation. In this case, the toner collection mode is performed when the development apparatus 1 is not in operation for a predetermined time period or longer, and predetermined temperature and humidity conditions are satisfied. Assume still another example case where the toner collection mode is intended to be performed during the sheet-to-sheet interval and post-rotation control. In this case, the toner collection mode is performed when the temperature and humidity variations reach respective predetermined values since the toner collection mode was last performed.

Assume still another example case where the toner collection mode is intended to be performed during the sheet-to-sheet interval and post-rotation control. In this case, the toner collection mode is performed when the variation of the average image duty reaches or exceeds a predetermined value since the toner collection mode was last performed. Assume still another example case where the toner collection mode is intended to be performed during the sheet-to-sheet interval and post-rotation control. In this case, the toner collection mode is performed when the long-term average image duty reaches or exceeds a predetermined value since the toner collection mode was last performed. Assume still another example case where the toner collection mode is intended to be performed during the sheet-to-sheet interval and post-rotation control. In this case, the toner collection mode is performed when the short-term average image duty falls down to or falls below a predetermined value since the toner collection mode was last performed.

The above-described toner collection mode execution conditions may be suitably combined, or the application of each of these conditions may be arbitrarily turned ON or OFF in a service mode. In addition, when either one of these toner collection mode execution conditions is satisfied and the toner collection mode is performed, it is necessary to reset to zero the number of recording material sheets that have been subjected to image forming since the toner collection mode was last performed.

Figure 20:
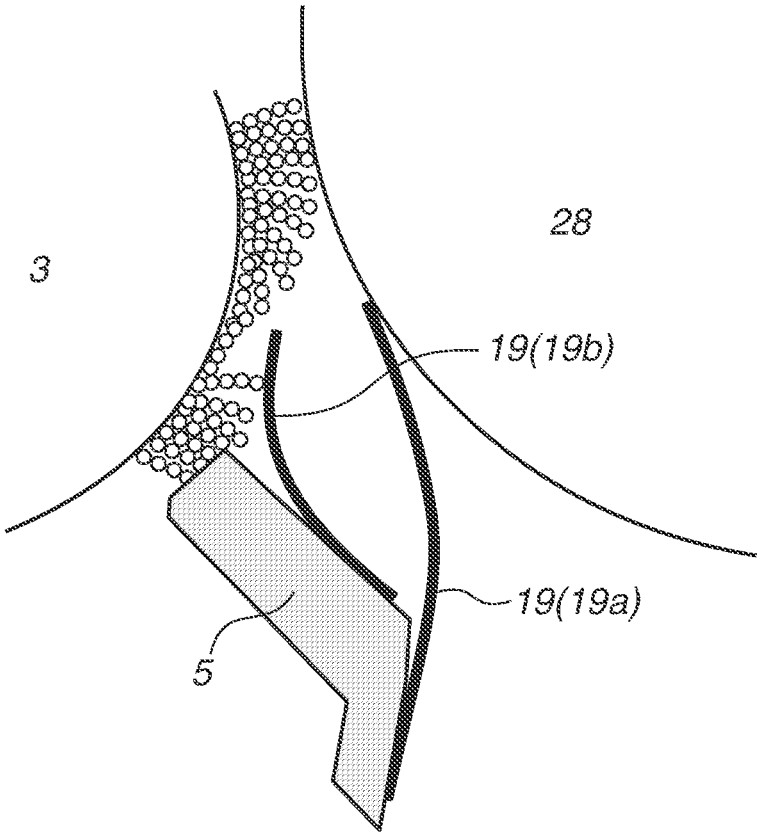
FIG. 20 is a cross-sectional view illustrating a configuration in the vicinity of a toner capture sheet according to a modification.

Although the exemplary embodiments have been described above centering on a development apparatus having one toner capture sheet 19 stuck on the regulation blade 5, as illustrated in FIG. 4, the present disclosure is not limited thereto. A modification where the development apparatus may have two toner capture sheets 19 stuck on the regulation blade 5, as illustrated in FIG. 20 is also applicable. Of the two toner capture sheets 19*a* and 19*b* stuck on the regulation blade 5, the sheet member (toner capture sheet) 19*a* is disposed in contact with the photosensitive drum 28 and configured to capture the toner scattered from the development region downward in the direction of gravity. The sheet member (toner capture sheet) 19*b* is disposed to face a development sleeve 3 in non-contact with the development sleeve 3 and configured to capture the toner scattered when the thickness of the developer layer passing through the SB gap is regulated by the regulation blade 5. In the development apparatus according to the modification having two toner capture sheets 19 stuck on the regulation blade 5, as illustrated in FIG. 20, the toner accumulating on the sheet member 19*a* is collected in the toner connection mode.

Although the exemplary embodiments have been described above centering on image forming apparatuses configured to use the intermediate transfer member 24, as illustrated in FIG. 1, the present disclosure is not limited thereto. The present disclosure is also applicable to image forming apparatuses configured to perform image transfer by sequentially bringing a recording material into direct contact with the photosensitive drums 28. In the configuration for performing image transfer by sequentially bringing a recording material into direct contact with the photosensitive drums 28, the sequence for separating the intermediate transfer member 24 from the photosensitive drums 28 (sequence for primary transfer separation) needs to be omitted in the toner collection mode.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-162159, filed Sep. 28, 2020, which is hereby incorporated by reference herein in its entirety.

What is claimed is:

1. An image forming apparatus comprising:

an image bearing member on which an electrostatic latent image is to be formed;

an exposure apparatus configured to expose the image bearing member to light to form the electrostatic latent image on the image bearing member;

a development apparatus including a development container, a developer bearing member, a magnet, and a regulation blade, wherein the development container is configured to accommodate a developer including a toner and a carrier, wherein the developer bearing member is rotatable and configured to bear and convey the developer to develop the electrostatic latent image formed on the image bearing member, wherein the magnet is non-rotatably and fixedly disposed in the developer bearing member and configured to generate a magnetic field to allow the developer bearing member to bear the developer, and wherein the regulation blade is disposed below a position on the developer bearing member where the developer bearing member is closest to the image bearing member, so as to face the developer bearing member in non-contact with the developer bearing member, and is configured to regulate an amount of the developer born by the developer bearing member;

a sheet member disposed below the position on the developer bearing member where the developer bearing member is closest to the image bearing member and in contact with the image bearing member, wherein the sheet member is configured to cover at least a part of a space partitioned by the regulation blade, the developer bearing member, and the image bearing member;

a drive unit configured to rotatably drive the developer bearing member; and a controller configured to control the drive unit to rotatably drive the developer bearing member in a first direction during image forming, wherein, during non-image forming, the controller executes a control mode for controlling the drive unit to rotatably drive the developer bearing member in a second direction opposite to the first direction, and then rotatably drive the developer bearing member in the first direction, and wherein a part of the sheet member above a horizontal line passing through a tip of the regulation blade is disposed in a moving path of the developer born by the developer bearing member in a case where the drive unit rotatably drives the developer bearing member in the second direction in the control mode, and is not disposed in the moving path of the developer born by the developer bearing member in a case where the drive unit rotatably drives the developer bearing member in the first direction during image forming.

2. The image forming apparatus according to claim 1, wherein the sheet member is in contact with the image bearing member in the case where the drive unit rotatably drives the developer bearing member in the second direction in the control mode, and is in contact with the image bearing member in a case where the drive unit rotatably drives the developer bearing member in the first direction in the control mode.

3. The image forming apparatus according to claim 1, wherein a potential difference between the developer bearing member and the image bearing member in a case where the drive unit rotatably drives the developer bearing member in the first direction in the control mode is different from the potential difference between the developer bearing member and the image bearing member in the case where the drive unit rotatably drives the developer bearing member in the first direction during image forming.

4. The image forming apparatus according to claim 3, wherein, in the case where the drive unit rotatably drives the developer bearing member in the first direction in the control mode, a surface potential of the image bearing member is 0 V.

5. The image forming apparatus according to claim 1, wherein a driving speed of the developer bearing member in a case where the drive unit rotatably drives the developer bearing member in the first direction in the control mode is lower than the driving speed of the developer bearing member in the case where the drive unit rotatably drives the developer bearing member in the first direction during image forming.

6. The image forming apparatus according to claim 1, wherein, in a case where an operation where the drive unit rotatably drives the developer bearing member in the second direction and then rotatably drives the developer bearing member in the first direction in the control mode is one set, the controller controls the drive unit to repeat the one set of the operation a plurality of times.

7. The image forming apparatus according to claim 1, wherein, in a case where a predetermined number of recording material sheets have been subjected to image forming, the controller executes the control mode.

8. The image forming apparatus according to claim 1, wherein the development apparatus further includes another sheet member disposed to face the developer bearing member in non-contact with the developer bearing member.

9. An image forming apparatus comprising:

an image bearing member on which an electrostatic latent image is formed;

an exposure apparatus configured to expose the image bearing member to light to form the electrostatic latent image on the image bearing member;

a development apparatus including a development container, a developer bearing member, a magnet, and a regulation blade, wherein the development container is configured to accommodate a developer including a toner and a carrier, wherein the developer bearing member is rotatable and configured to bear and convey the developer to develop the electrostatic latent image formed on the image bearing member, wherein the magnet is non-rotatably and fixedly disposed in the developer bearing member and configured to generate a magnetic field to allow the developer bearing member to bear the developer, and wherein the regulation blade is disposed below a position on the developer bearing member where the developer bearing member is closest to the image bearing member, so as to face the developer bearing member in non-contact with the developer bearing member, and is configured to regulate an amount of the developer born by the developer bearing member;

a sheet member disposed below the position on the developer bearing member where the developer bearing member is closest to the image bearing member and in contact with the image bearing member, wherein the sheet member is configured to cover at least a part of a space partitioned by the regulation blade, the developer bearing member, and the image bearing member;

a drive unit configured to rotatably drive the developer bearing member; and a controller configured to control the drive unit to rotatably drive the developer bearing member in a first direction during image forming, wherein, during non-image forming, the controller executes a control mode for controlling the drive unit to rotatably drive the developer bearing member in a second direction opposite to the first direction, and then rotatably drive the developer bearing member in the first direction, and wherein a part of the sheet member above a horizontal line passing through a tip of the regulation blade exists at a position in contact with a magnetic brush on the developer bearing member by the magnet in a case where the drive unit rotatably drives the developer bearing member in the second direction in the control mode, and at a position in non-contact with the magnetic brush on the developer bearing member by the magnet in a case where the drive unit rotatably drives the developer bearing member in the first direction during image forming.

10. The image forming apparatus according to claim 9, wherein the sheet member is in contact with the image bearing member in the case where the drive unit rotatably drives the developer bearing member in the second direction in the control mode, and is in contact with the image bearing member in a case where the drive unit rotatably drives the developer bearing member in the first direction in the control mode.

11. The image forming apparatus according to claim 9, wherein a potential difference between the developer bearing member and the image bearing member in a case where the drive unit rotatably drives the developer bearing member in the first direction in the control mode is different from a potential difference between the developer bearing member and the image bearing member in the case where the drive unit rotatably drives the developer bearing member in the first direction during image forming.

12. The image forming apparatus according to claim 11, wherein, in the case where the drive unit rotatably drives the developer bearing member in the first direction in the control mode, a surface potential of the image bearing member is 0 V.

13. The image forming apparatus according to claim 9, wherein a driving speed of the developer bearing member in a case where the drive unit rotatably drives the developer bearing member in the first direction in the control mode is lower than a driving speed of the developer bearing member in the case where the drive unit rotatably drives the developer bearing member in the first direction during image forming.

14. The image forming apparatus according to claim 9, wherein, in a case where an operation where the drive unit rotatably drives the developer bearing member in the second direction and then rotatably drives the developer bearing member in the first direction in the control mode is one set, the controller controls the drive unit to repeat the one set of the operation a plurality of times.

15. The image forming apparatus according to claim 9, wherein, in a case where a predetermined number of recording material sheets have been subjected to image forming, the controller executes the control mode.

16. The image forming apparatus according to claim 9, wherein the development apparatus further includes another sheet member disposed to face the developer bearing member in non-contact with the developer bearing member.

* * * * *